US012674609B2

(12) United States Patent
Schoeppner et al.

(10) Patent No.: US 12,674,609 B2
(45) Date of Patent: Jul. 7, 2026

(54) COMPRESSOR CONTROL BAND PROCESS FOR VARIABLE CASCADE REFRIGERATION SYSTEM

(71) Applicant: Trane Technologies Life Sciences LLC, Davidson, NC (US)

(72) Inventors: Thomas A. Schoeppner, Marietta, OH (US); Alex Roberts, Parkersburg, WV (US); Trace A. Lydick, Athens, OH (US)

(73) Assignee: Trane Technologies Life Sciences LLC, Davidson, NC (US)

( * ) Notice: Subject to any disclaimer, the term of this patent is extended or adjusted under 35 U.S.C. 154(b) by 173 days.

(21) Appl. No.: 18/585,725

(22) Filed: Feb. 23, 2024

(65) Prior Publication Data

US 2025/0271190 A1 Aug. 28, 2025

(51) Int. Cl.
*F25B 49/02* (2006.01)
*F25B 7/00* (2006.01)

(52) U.S. Cl.
CPC ..... *F25B 49/022* (2013.01); *F25B 7/00* (2013.01); *F25B 2600/0251* (2013.01); *F25B 2600/0253* (2013.01); *F25B 2700/2103* (2013.01)

(58) Field of Classification Search
CPC .. F25B 49/022; F25B 2700/2104; F25B 7/00; F25B 2600/025; F25B 2600/0253; F25B 2700/2103
See application file for complete search history.

(56) References Cited

U.S. PATENT DOCUMENTS 5,553,997 A 9/1996 Goshaw et al.
5,797,729 A 8/1998 Rafuse, Jr. et al.
(Continued)

FOREIGN PATENT DOCUMENTS

EP 0227504 B1 9/1989
EP 1443289 A1 8/2004
(Continued)

OTHER PUBLICATIONS

Merkushev, "Status notification led—Home Assistant," Mar. 2, 2022, 21 pages, https://brushknight.medium.com/status-notification-led-home-assistant-2eb800506ce2.
(Continued)

*Primary Examiner* — Jerry-Daryl Fletcher
*Assistant Examiner* — Daniel C Comings
(74) *Attorney, Agent, or Firm* — Womble Bond Dickinson (US) LLP

(57) ABSTRACT

A method and apparatus for controlling compressors in a cascade vapor compression system. The process may include controlling the operation of a first compressor based on a constant band control, and controlling the operation of a second compressor based on a proportional band control. Controlling the first compressor based on the constant band control may include operating the compressor at a constant setting if first measurements are within a range associated with a first setpoint. It may also include proportionally adjusting the operation of the first compressor if the first measurements are outside the range. Further, controlling the second compressor based on the proportional band control may include operating the compressor based on one of a plurality of proportional bands, each proportional band having a different proportional factor. Controlling the second compressor operation may further include switching
(Continued)

between these proportional bands based on a second measured parameter.

20 Claims, 9 Drawing Sheets

(56) References Cited

U.S. PATENT DOCUMENTS

| | | | | |
|---|---|---|---|---|
| 5,921,092 | A | 7/1999 | Behr et al. | |
| 6,058,723 | A | 5/2000 | Kusunoki et al. | |
| 6,324,856 | B1 | 12/2001 | Weng | |
| 6,557,358 | B2 | 5/2003 | Weng et al. | |
| 6,574,978 | B2 | 6/2003 | Flynn et al. | |
| 6,766,652 | B2 | 7/2004 | Kelly et al. | |
| 8,011,191 | B2 | 9/2011 | Wang et al. | |
| 8,020,389 | B2 | 9/2011 | Ascani | |
| 8,448,459 | B2 | 5/2013 | McSweeney et al. | |
| 8,590,327 | B2 | 11/2013 | Tobe et al. | |
| 8,826,677 | B2 | 9/2014 | Clodic et al. | |
| 9,021,823 | B2 | 5/2015 | Caillat | |
| 9,239,174 | B2 | 1/2016 | Rockenfeller et al. | |
| 9,429,347 | B2 | 8/2016 | Sugimoto et al. | |
| 9,476,625 | B2 | 10/2016 | McSweeney | |
| 9,494,354 | B2 | 11/2016 | McSweeney et al. | |
| 9,541,907 | B2 | 1/2017 | McSweeney | |
| 9,593,869 | B2 | 3/2017 | Asari et al. | |
| 9,597,970 | B2 | 3/2017 | DeBoer, III et al. | |
| 9,646,468 | B2 | 5/2017 | Smith et al. | |
| 9,683,563 | B2 | 6/2017 | Caillat | |
| 9,835,360 | B2 | 12/2017 | Wang et al. | |
| 9,989,280 | B2 | 6/2018 | Ali | |
| 10,072,876 | B2 | 9/2018 | Wang et al. | |
| 10,254,016 | B2 | 4/2019 | Sata et al. | |
| 10,760,825 | B2 | 9/2020 | Tamaoki et al. | |
| 10,816,243 | B2 | 10/2020 | Wang et al. | |
| 10,838,454 | B2 | 11/2020 | Salmon et al. | |
| 10,845,097 | B2 | 11/2020 | Wang et al. | |
| 10,962,009 | B2 | 3/2021 | Pham et al. | |
| 11,137,185 | B2 | 10/2021 | Farrar et al. | |
| 11,215,384 | B2 | 1/2022 | Bartlett et al. | |
| 11,566,820 | B2 | 1/2023 | Yamawaki et al. | |
| 11,927,380 | B2 | 3/2024 | Kawano et al. | |
| 2004/0139763 | A1 | 7/2004 | Jeong et al. | |
| 2007/0271936 | A1* | 11/2007 | Wakamoto | F25B 7/00 62/160 |
| 2009/0058246 | A1 | 3/2009 | Cittadini et al. | |
| 2009/0205344 | A1 | 8/2009 | Ascani | |
| 2009/0235678 | A1 | 9/2009 | Taras et al. | |
| 2011/0072836 | A1* | 3/2011 | Wang | F25B 49/022 62/507 |
| 2011/0138826 | A1 | 6/2011 | Lifson et al. | |
| 2012/0204581 | A1 | 8/2012 | Kang et al. | |
| 2015/0176866 | A1 | 6/2015 | Takayama et al. | |
| 2017/0343276 | A1 | 11/2017 | Cheon | |
| 2018/0106523 | A1 | 4/2018 | Besore et al. | |
| 2018/0347863 | A1* | 12/2018 | Tamaoki | F25B 49/025 |
| 2019/0242623 | A1 | 8/2019 | Chhajed | |
| 2022/0079823 | A1 | 3/2022 | Nahavandi et al. | |
| 2022/0087446 | A1 | 3/2022 | Friend et al. | |
| 2022/0366520 | A1 | 11/2022 | Sudman et al. | |

FOREIGN PATENT DOCUMENTS

| | | | |
|---|---|---|---|
| EP | 1674806 | A1 | 6/2006 |
| EP | 1783445 | A1 | 5/2007 |
| EP | 1869379 | B1 | 1/2010 |
| EP | 2995885 | B1 | 4/2020 |
| EP | 2522933 | B1 | 9/2020 |
| GB | 2442241 | A | 4/2008 |
| JP | 2008008593 | A | 1/2008 |
| WO | 2006/013762 | A1 | 2/2006 |

OTHER PUBLICATIONS

A1 Medical Integration, "Over Door / Patient Status Light—White," 2023, 2 pages, https://a1props.com/product/over-door-patient-status-light-white/.

Elo Touch Solutions, Inc., "Status Light (Gen 1)," 2024, 5 pages, Elo® Official Website, https://www.elotouch.com/accessories-status-light-gen-1.html.

Emerson: "E2 Installation and Operation Manual for RX Refrigeration, BX HVAC, and CX Convenience Store Controllers", Apr. 6, 2010 (Apr. 6, 2010), pp. 1-252, XP093291321, Retrieved from the Internet:URL:https://static-htpg.globalimageserver.com/_WP/img/docs/imos/coldzone/E2_User_Manual.pdf.

Emerson: "E2 Installation and Operation Manual for RX Refrigeration, BX HVAC, and CX Convenience Store 1 Controllers", Apr. 6, 2010 (Apr. 6, 2010), pp. 1-252, XP093291321, Retrieved from the Internet: URL:https://statichtpg. globalimageserver. com/_WP/img/docs/imos/coldzone/E2_User_Manual.pdf.

* cited by examiner

COMPRESSOR CONTROL BAND PROCESS FOR VARIABLE CASCADE REFRIGERATION SYSTEM

CROSS-REFERENCE TO RELATED APPLICATIONS

This application is related to U.S. application Ser. No. 18/585,852, entitled "Cold Storage Systems," naming Trace A. Lydick, Alex Roberts, Thomas A. Schoeppner, Benjamin T. Irwin, Mitchell J. Donnelly, and Luke Schlicher as inventors, and naming Trane Technologies Life Sciences LLC as the Applicant), and U.S. application Ser. No. 18/585,642 entitled "Defrost fan control," naming Thomas A. Schoeppner, Alex Roberts, Trace A. Lydick, and Mitchell J. Donnelly as inventors, and naming Trane Technologies Life Sciences LLC as the Applicant). Each of these applications is being filed on the same day as the instant application, and the entire contents of each of these applications is hereby incorporated by reference.

TECHNOLOGICAL FIELD

The present disclosure relates generally to improved controls for operating a compressor of a cascade refrigeration system, and it is particularly applicable for a cascade vapor compression system with two or more compressors.

BACKGROUND

Climate control systems may be used to adjust the climate of a conditioned space. Thus, many systems often include various components for controlling the temperature and other conditions associated with the conditioned space. In particular, climate control systems often include a compressor driven by a motor, and the compressor operation often varies based on the conditioning load associated with the conditioned space.

In order to control the compressor operation, various control processes may be utilized. For example, a standard off/on operation may be utilized to control the compressor motor, and in other instances, where a variable frequency drive (VFD) is connected to the motor, a more complex control process may be utilized, potentially a proportional and integral (PI) control process may be used to control the compressor operation.

These existing systems, however, are insufficient to appropriately control the compressors of a climate control system and balance the various competing demands, e.g., conditioning requirements, energy efficiency requirements, maintenance requirements, etc. This is particularly applicable to cascade systems where two refrigeration circuits run in series to address a conditioning load. As a result, there exists a need improve the compressor control process for climate control systems, and particularly for cascade vapor compression systems.

BRIEF SUMMARY

The present disclosure includes, without limitation, the following examples.

One embodiment is a method of controlling a cascade vapor compression system, the cascade vapor compression system including a first stage compressor configured to circulate refrigerant in a first stage refrigeration circuit, and a second stage compressor configured to circulate refrigerant in a second stage refrigeration circuit, the method comprising: receiving first measurements over time indicative of a first parameter associated with the cascade vapor compression system; receiving second measurements over time indicative of a second parameter associated with the second stage refrigeration circuit; controlling a speed of the first stage compressor based on a constant band control, wherein controlling the first stage compressor based on the constant band control includes: operating the first stage compressor at a constant speed setting upon determining that the first measurements are within a target parameter band, wherein the target parameter band is defined by a first setpoint and a band offset, and adjusting the speed of the first stage compressor based on a proportional rate control upon determining that the first measurements are outside the target parameter band and within a first threshold and a second threshold; and controlling a speed of the second stage compressor based on a proportional band control, wherein controlling the speed of the second stage compressor based on the proportional band control is based on, in part, the second measurements and a second setpoint, the proportional band control further including a plurality of proportional bands, each of the plurality of proportional bands including a different proportional factor than any other proportional band in the plurality of proportional bands.

Another embodiment is a method of controlling a cascade vapor compression system, the cascade vapor compression system including a first stage compressor configured to circulate refrigerant in a first stage refrigeration circuit, and a second stage compressor configured to circulate refrigerant in a second stage refrigeration circuit, the method comprising: receiving first measurements over time indicative of a first parameter associated with the cascade vapor compression system; receiving second measurements over time indicative of a second parameter associated with the second stage refrigeration circuit; controlling a speed of the first stage compressor based on a constant band control, wherein controlling the speed of the first stage compressor based on the constant band control includes, in part, a comparison between the first measurements and a first setpoint, the constant band control further including a constant speed setting; and controlling a speed of the second stage compressor based on a proportional band control, wherein controlling the speed of the second stage compressor based on the proportional band control includes: identifying an operating proportional band from a plurality of proportional bands, each of the plurality of proportional bands including a maximum operating speed, a minimum operating speed, and a proportional factor, wherein each of the plurality of proportional bands includes a different proportional factor than any other proportional band in the plurality of proportional bands, and adjusting the speed of the second stage compressor based on the operating proportional band and the second measurements.

Another embodiment is a method of controlling a cascade vapor compression system, the cascade vapor compression system including a first stage compressor configured to circulate refrigerant in a first stage refrigeration circuit, and a second stage compressor configured to circulate refrigerant in a second stage refrigeration circuit, the method comprising: receiving first measurements over time indicative of a measured parameter associated with the cascade vapor compression system; receiving second measurements over time indicative of a measured parameter associated with the second stage refrigeration circuit; controlling a speed of the first stage compressor based on a constant band control, wherein controlling the first stage compressor based on the constant band control includes: operating the first stage compressor at a constant speed setting upon determining that the first measurements are within a target parameter band, wherein the target parameter band is defined by a first setpoint and a band offset, and adjusting the speed of the first stage compressor based on a proportional rate control upon determining that the first measurements are outside the target parameter band and within a first threshold and a second threshold; and controlling a speed of the second stage compressor based on a proportional band control, wherein controlling the speed of the second stage compressor based on the proportional band control includes: identifying an operating proportional band from a plurality of proportional bands, each of the plurality of proportional bands including a maximum operating speed, a minimum operating speed, and a proportional factor, wherein each of the plurality of proportional bands includes a different proportional factor than any other proportional band in the plurality of proportional bands, and adjusting the speed of the second stage compressor based on the operating proportional band and the second measurements.

Another embodiment is a cascade vapor compression system comprising: a first stage compressor configured to circulate refrigerant in a first stage refrigeration circuit; a second stage compressor configured to circulate refrigerant in a second stage refrigeration circuit; and a controller operably coupled to the first stage compressor and the second stage compressor, the controller including a processor and a memory configured to store computer-readable program code including a control-related software application; and the processor configured to access the memory, and execute the computer-readable program code to cause the processor to at least: receive first measurements over time indicative of a first parameter associated with the cascade vapor compression system; receive second measurements over time indicative of a second parameter associated with the second stage refrigeration circuit; control a speed of the first stage compressor based on a constant band control, wherein causing the processor to control the speed of the first stage compressor based on the constant band control further includes causing the processor to: operate the first stage compressor at a constant speed setting upon determining that the first measurements are within a target parameter band, wherein the target parameter band is defined by a first setpoint and a band offset, and adjust the speed of the first stage compressor based on a proportional rate control upon determining that the first measurements are outside the target parameter band and within a first threshold and a second threshold; and control a speed of the second stage compressor based on a proportional band control, wherein controlling the second stage compressor based on the proportional band control is based on, in part, the second measurements and a second setpoint, the proportional band control further including a plurality of proportional bands, each of the plurality of proportional bands including a different proportional factor than any other proportional band in the plurality of proportional bands.

Another embodiment is a cascade vapor compression system comprising: a first stage compressor configured to circulate refrigerant in a first stage refrigeration circuit; a second stage compressor configured to circulate refrigerant in a second stage refrigeration circuit; and a controller operably coupled to the first stage compressor and the second stage compressor, the controller including a processor and a memory configured to store computer-readable program code including a control-related software application; and the processor configured to access the memory, and execute the computer-readable program code to cause the processor to at least: receive first measurements over time indicative of a first parameter associated with the cascade vapor compression system; receive second measurements over time indicative of a second parameter associated with the second stage refrigeration circuit; control a speed of the first stage compressor based on a constant band control, wherein controlling the speed of the first stage compressor based on the constant band control includes, in part, a comparison between the first measurements and a first setpoint, the constant band control further including a constant speed setting; and control a speed of the second stage compressor based on a proportional band control, wherein causing the processor to control the speed of the second stage compressor based on the proportional band control further includes causing the processor to: identify an operating proportional band from a plurality of proportional bands, each of the plurality of proportional bands including a maximum operating speed, a minimum operating speed, and a proportional factor, wherein each of the plurality of proportional bands includes a different proportional factor than any other proportional band in the plurality of proportional bands, and adjust the speed of the second stage compressor based on the operating proportional band and the second measurements.

Another embodiment is a cascade vapor compression system comprising: a first stage compressor configured to circulate refrigerant in a first stage refrigeration circuit; a second stage compressor configured to circulate refrigerant in a second stage refrigeration circuit; and a controller operably coupled to the first stage compressor and the second stage compressor, the controller including a processor and a memory configured to store computer-readable program code including a control-related software application; and the processor configured to access the memory, and execute the computer-readable program code to cause the processor to at least: receive first measurements over time indicative of a first parameter associated with the cascade vapor compression system; receive second measurements over time indicative of a second parameter associated with the second stage refrigeration circuit; control a speed of the first stage compressor based on a constant band control, wherein causing the processor to control the speed of the first stage compressor based on the constant band control further includes causing the processor to: operate the first stage compressor at a constant speed setting upon determining that the first measurements are within a target parameter band, wherein the target parameter band is defined by a first setpoint and a band offset, and adjust the speed of the first stage compressor based on a proportional rate control upon determining that the first measurements are outside the target parameter band and within a first threshold and a second threshold; and control a speed of the second stage compressor based on a proportional band control, wherein causing the processor to control the speed of the second stage compressor based on the proportional band control further includes causing the processor to: identify an operating proportional band from a plurality of proportional bands, each of the plurality of proportional bands including a maximum operating speed, a minimum operating speed, and a proportional factor, wherein each of the plurality of proportional bands includes a different proportional factor than any other proportional band in the plurality of proportional bands, and adjust the speed of the second stage compressor based on the operating proportional band and the second measurements.

These and other features, aspects, and advantages of the disclosure will be apparent from a reading of the following detailed description together with the accompanying drawings, which are briefly described below. The disclosure includes any combination of two, three, four, or more of the above-noted embodiments, examples, or implementations as well as combinations of any two, three, four, or more features or elements set forth in this disclosure, regardless of whether such features or elements are expressly combined in a specific example description herein. This disclosure is intended to be read holistically such that any separable features or elements of the disclosed disclosure, in any of its various aspects, embodiments, examples, or implementations, should be viewed as intended to be combinable unless the context clearly dictates otherwise.

BRIEF DESCRIPTION OF THE FIGURE(S)

Having thus described example implementations of the disclosure in general terms, reference will now be made to the accompanying figures, which are not necessarily drawn to scale, and wherein:

DETAILED DESCRIPTION

Figure 1:
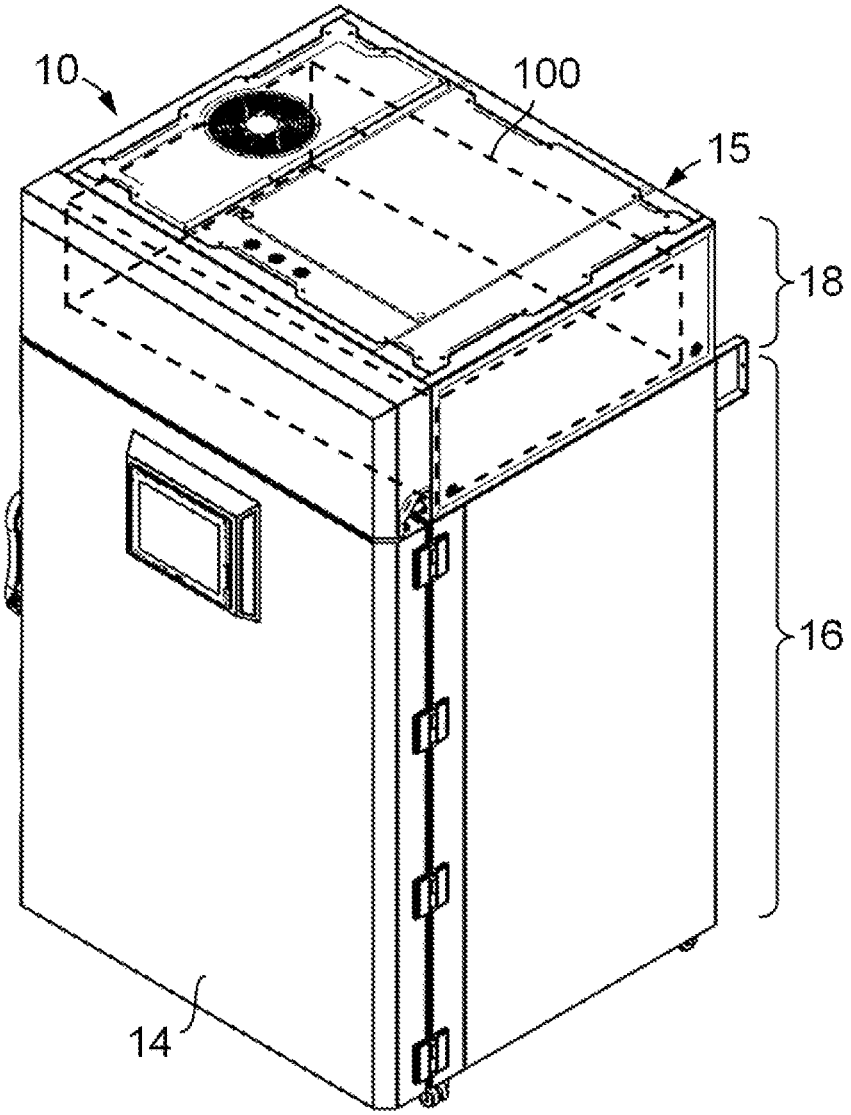
FIG. 1 is a perspective view of a cold storage system according to some example implementations.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form.

The disclosure herein describes various control processes that may be used to control the operation of one or more compressors used in a climate control system. These control processes may be particularly suited for cascade vapor compression systems, which include at least two refrigerant cycles transporting heat in series. In particular, it may be advantageous to control one of the compressors in a cascade vapor compression system using a first control process, such as the constant band control process described herein, and another of the compressors in the cascade vapor compression system using a second control process, such as the proportional band control process described herein.

To provide more context, cascade vapor compression systems often involve transporting heat across elevated temperature differentials, e.g., ultra-low temperature storage. In order to achieve these high temperature differentials, cascade systems often use a first refrigerant circuit to transport heat between a given temperature, e.g., the outside ambient temperature, and an intermediate temperature. The system then uses a second refrigerant circuit to transport heat between the intermediate temperature and another temperature, often a desired temperature for conditioning. More circuits (and intermediate temperatures) can be used, but regardless, the result is that while these circuits may transport approximately the same heat across a given temperature gradient, the circuits do so under different conditions and considerations.

For example, the first circuit, often utilizes the outdoor ambient environment as the heat sink/source, and that environment can vary considerably. For example, if the outdoor ambient environment is used then the conditions may vary based on the local weather. In other examples, a system may be located within an indoor space, e.g., a freezer may use a room (which may or may not be conditioned) and the room may be the ambient environment for the freezer. In these examples, the freezer may use that room as the ambient environment that provides the heat source/sink for at least one of the refrigerant circuits. Regardless, in some examples, this first circuit may be used to transfer heat from (or to) the second circuit via an interstage heat exchanger. In contrast, the second circuit may be designed to condition a given space or for another conditioning requirement, e.g., condition a heat transfer fluid, and the second circuit may be driven based on the changing conditioning needs that result. However, current control systems for cascade systems often do not take into account these differing considerations, and often control each of the various circuits based on the same or similar processes. This typically results in sub-optimal performance of one or both refrigeration circuits and sub-optimal performance of the overall system.

The present disclosure addresses this issue, while also providing for improved control processes overall. For example, this disclosed process includes utilizing separate control processes for each of these refrigeration circuits. Each of these processes are directed to issues present in its respective circuits, and each of these processes also offer improved controls over current control processes generally.

To walk through a further example, the disclosed process includes operating a first compressor in the first refrigerant circuit based on a constant band control process. In this example, the first compressor is driven to achieve a constant temperature for the interstage heat exchanger. This may be appropriate to enable the overall system to utilize that heat exchanger as a constant heat source/sink for the second stage circuit. As a result, this control process may be designed to determine an appropriate operating level for the first stage compressor, and then once that operating level is determined (or otherwise set) operating the compressor at that operating level whenever possible.

In this example, the first stage refrigerant circuit may include a setpoint for the interstage heat exchanger, and it may also include a target parameter band associated with the setpoint. The setpoint may be the desired temperature for the interstage heat exchanger during operation, and the target parameter band may be a range of temperatures deemed appropriate or acceptable that are close to the setpoint. The process may further include monitoring the temperature of the interstage heat exchanger, and adjusting the operation of the compressor based on the difference between the monitored temperature and the setpoint.

This constant band control may also include a process for determining the appropriate operating level for the compressor, e.g., determining the constant control setting. Here, the compressor may determine this setting based on the first time the system is turned on, potentially after installation. This may be beneficial because after installation the system (and various components) may be set up in their manufacturing configurations, and thus this initial operation may be indicative of a preferred or standard operation of the system. Regardless, once the system has been turned on it may operate at the maximum operating level to bring the measured temperature closer to the desired setpoint. For example, at this time, the measured temperature may be above a high proportional band limit for the constant control process which may result in the process operating at its maximum operating level. As the temperature measurements begin to approach the setpoint, the measured temperature may lower to below the high proportional band limit, and in which case, the constant band control process may adjust the compressor operation level based on a proportional rate control. As the temperature measurements continue to approach the setpoint, typically decreasing, the constant band control process may continue to decrease the compressor's operating level based on the proportional rate control. Once the temperature measurements come within the target parameter band, the constant control process may begin recording the operating level values. During this time, the constant band control may continue to adjust the compressor operating level based on the proportional rate control. Once the temperature measurements leave the target temperature band, the constant band control process may determine the constant control setting. This constant control setting may be the average of the operating levels recorded while the measured temperatures were within the target temperature band.

Once this constant control setting is determined then the constant band control process controls the compressor to the constant control setting when the measured temperatures are within the target temperature band. As a result, the constant band control will be able to continue to operate this compressor at a level that was determined to be appropriate under known conditions. Further, after this constant control setting is determined, the constant band control process may continue to utilize the other controls discussed above. For example, if the measured temperature is above the high proportional band limit, then the constant band control process may control the compressor to a maximum operating level. If the measured temperature is below a low proportional band limit, then the constant band control process may control the compressor to a minimum operating level. If the measured temperature is between the high proportional band limit and the low proportional band limit but outside the target temperature band, then the constant band control process may control the compressor based on a proportional rate control. And again, if the measured temperatures are within the constant band, then the constant band control process may control the compressor to the constant control setting. The below walks through this constant band control process in more detail and includes additional and/or alternative features as well.

Turning to the other control process, the disclosed system may also use a proportional band control process. This process may be used on the second stage refrigeration circuit in a climate control system, in part, because this process may provide a process that allows for more continuous adjustments as a measured parameter approaches a given setpoint. This proportional band control process includes a plurality of different proportional bands and the process switches between these bands to achieve a desired control process via the proportional bands.

Each proportional band may include a maximum operating level, a minimum operating level, and a proportional factor. And each proportional band may include different values. For example, the plurality of proportional bands may be arranged in a manner such that the maximum operating band continues to decrease, and with each decrease the proportional factor also decreases. For example, the first proportional band may be set to where the maximum operating level is the maximum rated operating level of the compressor, e.g., 100%, and the minimum operating level is set as the minimum rated operating level for the compressor, e.g., 30%. The proportional factor for this first proportional band may be based on the difference between these maximum and minimum operating levels. The next proportional band may maintain this same minimum operating level, e.g., the 30% setting, and it may decrease the maximum operating level by 5%, e.g., the maximum operating level for the second proportional band may be 95%. In this example, the proportional factor for this second proportional band also decreases based on this lower maximum operating level. This process continues such that each successive proportional band includes the same minimum operating level, e.g., 30%, but a lower maximum operating level, e.g., 90%, 85%, etc., and the proportional factor also decreases. As a result, the proportional factors continue to narrower in operating range and the proportional factor continues to decrease, which may allow for the proportional bands to progressively provide less responsive adjustments to the compressor operation as the process adjusts to focus in on a preferred desirable operating range.

Further, the proportional band control process may switch between these proportional bands to determine how responsive the adjustment process should be. For example, the proportional band control process may switch between higher level operating bands, e.g., bands with higher maximum operating levels, to lower operating bands, e.g., bands with lower maximum operating levels. This switching may be initiated based on whether a given proportional band is able to achieve a desired setpoint, and potentially whether the measured parameters are at or below the desired setpoint for a certain period of time. For example, if the measured parameters are below the desired setpoint for a given length of time, then the proportional band control process may switch to a lower operating band, e.g., a band with a lower maximum operating level. This process of switching may continue each time the measured temperature remains at or below the desired temperature. However, if the measured parameters are above the desired setpoint, and the proportional band is unable to adjust the measured parameters to at or below the desired setpoint, then the proportional band control process may switch to a higher operating band, e.g., a band with a higher maximum operating level. This switch process may continue as long as the proportional control band is unable to satisfy a given temperature setpoint. The below walks through this proportional band control process in more detail and includes additional and/or alternative features as well. Further, as can be understood from the description provided herein, these control processes may be utilized with a cascade vapor compression system, a single cycle climate control process, or even control processes in different fields.

Turning to the figures, the below walks through a more detailed discussion of an example cascade vapor compression system, which may utilize these control processes along with examples of each of the control processes.

Figure 2:
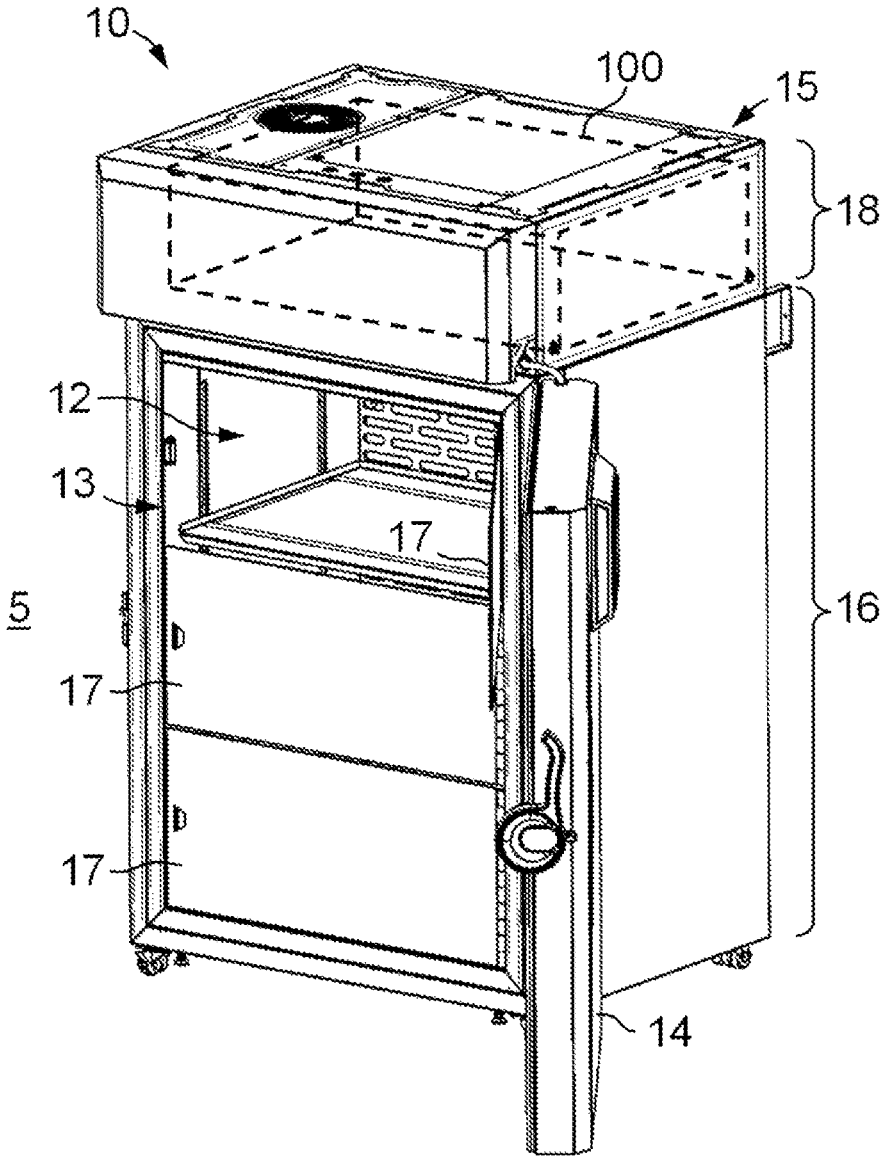
FIG. 2 is another perspective view of the cold storage system of FIG. 1, showing an outer door open to review an inner storage chamber therein according to some example implementations.

Referring now to FIGS. 1 and 2, a cold storage system 10 according to some embodiments is shown. The cold storage system 10 may be configured to store degradable products (e.g., such as life-science products and materials) at temperatures below the freezing point of water (e.g., 0° C. or 32° F.) or lower (e.g., below −20° C., below −40° C., below −70° C., below −80° C., etc.). Thus, the cold storage system 10 may be more simply referred to herein as a "freezer." In some embodiment, the freezer may be configured to store products in ultra-low temperatures below −50° C. However, it should be appreciated that other embodiments of cold storage system 10 may be configured to store products at temperatures that are above the freezing point of water.

Generally speaking, the cold storage system 10 includes a housing 15 that defines one or more inner storage chambers 12 (or more simply "chamber" or "chambers"). In the embodiment illustrated in FIG. 2, the housing 15 includes a single chamber 12 that is accessible via an outer door 14. Specifically, the chamber 12 may include a front opening 13 that is closeable by the outer door 14 during operations. Thus, the chamber 12 is at least partially defined by the outer door 14. When the door 14 is closed to thereby occlude or cover the front opening 13 (FIG. 1), the chamber 12 is isolated or substantially closed-off from the surrounding environment 5, and when the door 14 is opened (FIG. 2), the chamber 12 is exposed to the surrounding environment 5 via the front opening 13. In some embodiments, the cold storage system 10 may define a plurality of separate chambers 12 that may be accessible via the outer door 14 or a plurality of outer doors 14.

As shown in FIG. 2, the chamber 12 may have one or more (e.g., a plurality of) inner doors 17 positioned therein that are configured to at least partially close the front opening 13 independently of the outer door 14. The one or more inner doors 17 may provide an additional barrier (that is, in addition to the outer door 14) to minimize air exchange between the chamber 12 and the ambient environment 5 when the outer door 14 is opened. The number and arrangement of inner doors 17 may correspond to the shelving or other organizational support structure that is inserted within the chamber 12 so that a user may open an inner door 17 that is associated with a particular storage location (e.g., such as a particular shelf).

In addition, the cold storage system 10 include a climate control system 100 that are operably coupled to the chamber 12. Specifically, the chamber 12 may be conditioned by a single climate control system 100 that is configured to achieve and/or maintain a desired temperature (or temperature range) within the chamber 12 during operations. The climate control system 100 may comprise a vapor compression refrigeration system or module (or more simply "refrigeration module") that circulates one or more refrigerants to exchange heat between the chamber 12 and environment 5 during operations. In some embodiments, the climate control system 100 may comprise a cascade refrigeration module that has a plurality of staged refrigerant circuits that are in thermal communication with one another and that are configured to achieve and/or maintain a low temperature within the chamber 12 during operations.

The housing 15 may define or include a first or upper portion 18 and a second or lower portion 16 that is positioned vertically below and lower than the upper portion 18. The climate control system 100 may substantially define the upper portion 18 and the chamber 12 may substantially define the lower portion 16. Thus, the climate control system 100 (or at least the majority thereof) may be positioned vertically higher and indeed vertically above the chamber 12. Additional features of the chamber 12 and climate control system 100 are provided herein according to some embodiments.

In addition, in some embodiments, the position of the climate control system 100 relative to the chamber 12 and lower portion 16 of housing 15 may be varied. For instance, in some embodiments, the climate control system 100 (or a portion thereof) may be placed along a lateral side or back of the lower portion 16 of housing 15, or even potentially along a bottom side of the lower portion 16 of housing 15.

The freezer 10 may operate using electrical power supplied from a line power source (e.g., a local electrical grid). In addition, the freezer 10 may include (or be coupled to) one or more back-up batteries, capacitors, generators, etc. (collectively "back-up power sources"—not shown) to ensure freezer 10 (or one or more components or subsystems thereof) remains operable in the event of a failure of the line power source. In some embodiments, the one or more back-up power sources may operate a user interface (e.g., user interface 300 described herein) and one or more sensors (e.g., temperature sensor 128) of freezer 10, but a remainder of the freezer 10 may become inoperable upon a loss or failure of the line power source.

Figure 3:
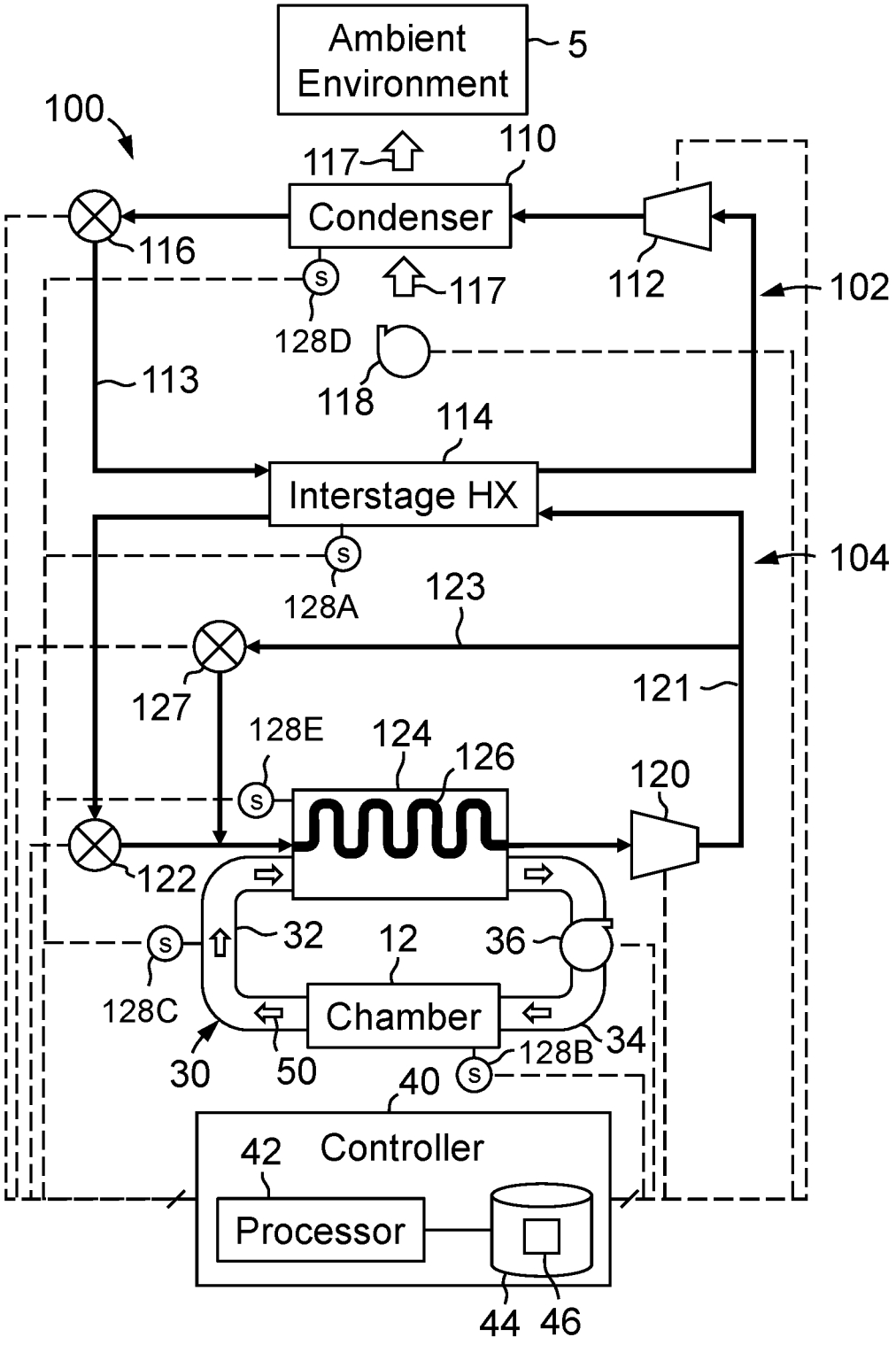
FIG. 3 is a schematic view of a climate control system of the cold storage system of FIG. 1 according to some example implementations.

FIG. 3 shows a schematic diagram of the climate control system 100 of freezer 10 according to some embodiments. In some embodiments, the climate control system 100 is a refrigeration system that is configured circulate a refrigerant (or multiple refrigerants) to cool the chamber 12 during operations. In particular, the climate control system 100 may comprise a so-called cascade refrigeration system, that includes a plurality of separate, staged refrigerant circuits 113, 121 that are thermally coupled to one another for transferring heat between the chamber 12 and the ambient environment 5. In some embodiments, the climate control system 100 may be configured to achieve and/or maintain low temperatures in the chamber 12 (e.g., such as "ultra-low"). Thus, the climate control system 100 may be referred to herein as a "cascade vapor compression system," a "cascade refrigeration system", or more simply a "refrigeration system." As discussed herein, other climate control systems, such as a single stage climate control systems may also utilize the features disclosed herein.

As shown in FIG. 3, the climate control system 100 may include a first refrigeration stage 102 (or more simply "first stage" 102) having a first refrigerant circuit 113 that circulates a first refrigerant, and a second refrigeration stage 104 (or more simply "second stage" 104) having a second refrigerant circuit 121 that circulates a second refrigerant. The first and second refrigerants may comprise any suitable refrigerant or combination of refrigerants such as, for instance, one or more chlorofluorocarbons, hydrochlorofluorocarbons, hydrocarbons, ammonia, etc. The first and second refrigerant may be different from one another, and particularly may have different phase change temperatures. The first and second refrigerants may be selected so that at the operating pressures of the first and second refrigerant circuits 113, 121, the saturated condensing temperature range of the second refrigerant (in the second refrigerant circuit 121) overlaps with saturated evaporating temperature of the first refrigerant (in the first refrigerant circuit 113) in an interstage heat exchanger (e.g., the interstage heat exchanger 114 described herein) so that each of the first refrigerant and second refrigerant may experience a change in enthalpy when thermally interacting with one another during operations (e.g., via the interstage heat exchanger 114 described herein).

Generally speaking, during operations, the climate control system 100 may circulate the first and second refrigerants through the first and second refrigerant circuits 113, 121, respectively, in order to transfer heat from the chamber 12 to the ambient environment 5. Heat may be transferred between the first and second refrigerants via an interstage heat exchanger 114 that is coupled to and is a part of each of the first refrigerant circuit 113 and second refrigerant circuit 121.

More specifically, the first refrigerant circuit 113 may circulate the first refrigerant between a first stage compressor 112 (or more simply "compressor 112"), a condenser 110, a first stage expansion valve 116 (or more simply "expansion valve" or "valve"), and the interstage heat exchanger 114 in order to transfer heat from the second refrigerant circuit 121 (described in more detail herein), and the ambient environment 5. Specifically, the compressor 112 may compress the first refrigerant and output the compressed first refrigerant to the condenser 110. The first refrigerant flowing to and through the compressor 112 may be in a vapor state (or substantially in a vapor state) due to heat exchange within the interstage heat exchanger 114. The condenser 110 may comprise a heat exchanger (or collection of heat exchangers) that is configured to cool the first refrigerant by transferring heat from the first refrigerant to the ambient environment 5, such as by convection, radiation, and/or any other suitable mode of heat transfer. For instance, in the embodiment illustrated in FIG. 3, a blower or fan 118 may generate an airflow 117 that is in thermal contact with the first refrigerant via the condenser 110 so that during operations the first refrigerant transfers heat to the airflow 117 and cools so as to condense or partially condense from a vapor into a liquid. The heated airflow 117 may flow outward and away from the condenser 110 and into the ambient environment 5. In some embodiments, the condenser 110 may transfer heat from the first refrigerant to the ambient environment 5 via natural convection and/or radiation either in addition or in alternative to the forced convection via airflow 117. Accordingly, in some embodiments, the fan 118 may be omitted.

The liquid (or at least partially liquid) first refrigerant may be emitted from the condenser 110 and then expanded through the expansion valve 116 so as to at least partially vaporize and further cool the first refrigerant. Thereafter, the cooled first refrigerant is flowed into the interstage heat exchanger 114.

Within the interstage heat exchanger 114, heat is transferred from the second refrigerant flowing through the second refrigerant circuit 121 to the first refrigerant so that the first refrigerant changes phase (or substantially changes phase) in the interstage heat exchanger 114 from a liquid to a vapor. Thus, the interstage heat exchanger 114 may function as an evaporator for the first refrigerant of the first refrigerant circuit 113. The heated and vaporized (or partially vaporized) first refrigerant is then emitted from the interstage heat exchanger 114 and flowed back to the first stage compressor 112 to restart the cycle described above.

Referring still to FIG. 3, the second refrigerant circuit 121 may circulate the second refrigerant between a second stage compressor 120 (or more simply "compressor 120"), the interstage heat exchanger 114, a second stage expansion valve 122 (or more simply "expansion valve" or "valve"), and an evaporator 124, in order to transfer heat from the chamber 12 to the first refrigerant circuit 113. Specifically, the compressor 120 may compress the second refrigerant and output the compressed second refrigerant to the interstage heat exchanger 114. The second refrigerant flowing to and through the compressor 120 may be in a vapor (or substantially vapor) state due to heat exchange within the evaporator 124. Within the interstage heat exchanger 114, heat may be transferred from the second refrigerant to the first refrigerant as previously described. As a result, within the interstage heat exchanger 114, the second refrigerant may cool so as to condense or partially condense from a vapor into a liquid. Thus, the interstage heat exchanger 114 may function as a condenser for the second refrigerant of the first refrigerant circuit 121.

The liquid (or at least partially liquid) second refrigerant may be emitted from the interstage heat exchanger 114 and then expanded through the expansion valve 122 so as to at least partially vaporize and further cool the second refrigerant. Thereafter, the cooled second refrigerant is flowed into the evaporator 124.

The evaporator 124 is a heat exchanger that is configured to transfer heat from the chamber 12 to the second refrigerant. Specifically, the cooled second refrigerant is flowed through a coil 126 that is thermally exposed to an airflow 50 in the evaporator 124 so that heat is transferred from the airflow 50 to the second refrigerant to thereby cause the second refrigerant to change phase (or substantially change phase) from a liquid to a vapor. The airflow 50 may be generated by a blower or fan 36 that is positioned along ducting 30 that is configured to direct the airflow between the chamber 12 and evaporator 124 during operations. Specifically, the ducting 30 includes a suction duct 32 that is configured to direct the airflow 50 from the chamber 12 to the evaporator 124, and a discharge duct 34 that is configured direct the airflow 50 from the evaporator 124 to the chamber 12. The blower 36 may be positioned along or adjacent to the discharge duct 34; however, other positions for the blower 36 are contemplated herein (e.g., such as in the suction duct, in the chamber 12, etc.).

In some examples, the blower 36 and associated duct(s) may not be necessary. In these examples, the climate control system 100 may be coupled to a heat transfer fluid used to transport the thermal energy to the evaporator. For example, the freezer may be a cold wall freezer that uses glycol (or another fluid) to circulate heat from a cold wall (or plate) to the evaporator 124. In these systems the fluid receives the heat at the given location, e.g., wall, plate, etc., which typically raises the temperature of the heat transfer fluid. The heat transfer fluid then travels back to the evaporator 124 where the evaporator 124 receives the heat, which typically lowers the temperature of the heat transfer fluid. The heat transfer fluid then returns to the given location at this lower temperature and repeats this cycle. In these examples, a pump is often used instead of a fan to circulate this fluid to transport the heat. Similarly, a chiller may also use water (or another fluid) in a similar manner to transport heat to the evaporator 124. It is further understood that in examples where the system is operating as a heat pump the heat transfer would flow in the reverse and the heat exchanger would be a condenser. Again, other configurations may be utilized.

Referring still to FIG. 3, during operation, the climate control system 100 may substantially lower the temperature in the chamber 12. As previously described, the climate control system 100 may be configured to achieve and/or maintain ultra-low temperatures in the chamber 12 and humidity levels, with the ambient environment 5 being maintained at normal indoor conditions (e.g., such as temperatures in a range of about 18-24° C. (about 65-75° F.) and relative humidity levels in a range of about 30-60%) in some examples). In some embodiments, the ambient environment 5 may include temperatures that are less than normal indoor conditions (e.g., less than 18° C. or 65° F.), but may still be warmer than the temperature in the chamber 12. Air at temperatures warmer than that of the chamber 12 may also include greater relative humidity values than that found in the chamber 12. As a result, when the outer door 14 is opened, the relatively warm and humid air from the ambient environment 5 may flow into the substantially colder chamber 12 and eventually cause ice formation therein. Of particular note, the airflow 50 circulating between the evaporator 124 and the chamber 12 may lead to substantial ice formation on the coil 126 of the evaporator 124 which may degrade the heat transfer functionality of the evaporator 124. As a result, the climate control system 100 may periodically perform a defrost operation to remove ice that has accumulated on the coil 126. The defrost operation may include a so-called "hot gas bypass" and/or a separate supplemental heat source.

A controller 40 may be communicatively coupled (via any suitable wired and/or wireless connection) to various components of the climate control system 100 (e.g., compressors 112, 120, condenser 110, expansion valves 116, 122, valve 127, etc.). As described in more detail herein, the controller 40 may at least partially direct or control the operation of the climate control system 100 during operations. The controller 40 may be (or may be incorporated within) a main or master controller for the freezer 10, or the controller 40 may be a standalone controller 40 for controlling the climate control system 100 or a portion thereof. Regardless, the controller 40 may be described and referred to herein as being a part of the climate control system 100 and more broadly part of the freezer 10 (FIGS. 1 and 2).

The controller 40 may comprise one or more computing devices, such as a computer, tablet, smartphone, server, circuit board, or other computing device(s) or system(s). Thus, controller 40 may include a processor 42 and a memory 44.

The processor 42 may include any suitable processing device or a collection of processing devices. In some embodiments, the processor 42 may include a microcontroller, central processing unit (CPU), graphics processing unit (GPU), timing controller (TCON), scaler unit, or some combination thereof. During operations, the processor 42 executes machine-readable instructions (such as machine-readable instructions 46) stored on memory 44, thereby causing the processor 42 to perform some or all of the actions attributed herein to the controller 40. In general, processor 42 fetches, decodes, and executes instructions (e.g., machine-readable instructions 46). In addition, processor 42 may also perform other actions, such as, making determinations, detecting conditions or values, etc., and communicating signals. If processor 42 assists another component in performing a function, then processor 42 may be said to cause the component to perform the function.

The memory 44 may be any suitable device or collection of devices for storing digital information including data and machine-readable instructions (such as machine-readable instructions 46). For instance, the memory 44 may include volatile storage (such as random-access memory (RAM)), non-volatile storage (e.g., flash storage, read-only memory (ROM), etc.), or combinations of both volatile and non-volatile storage. Data read or written by the processor 42 when executing machine-readable instructions 46 can also be stored on memory 44. Memory 44 may include "non-transitory machine-readable medium," where the term "non-transitory" does not include or encompass transitory propagating signals.

The processor 42 may include one processing device or a plurality of processing devices that are distributed within (or communicatively coupled to) controller 40 or more broadly within climate control system 100 and/or freezer 10 (FIG. 1). Likewise, the memory 44 may include one memory device or a plurality of memory devices that are distributed within (or communicatively coupled to) controller 40 or more broadly within climate control system 100 and/or freezer 10 (FIG. 1). Thus, the controller 40 may comprise a plurality of individual "controllers" distributed throughout the climate control system 100 and/or freezer 10 (FIG. 1).

The controller 40 may be communicatively coupled (e.g., via wired and/or wireless connections) to one or more components of the climate control system 100. For example, as shown in FIG. 3, the controller 40 may be communicatively coupled to the compressors 112, 120, valves 116, 122, 127, blowers 118, 36, or some subset thereof. During operations, the controller 40 may control an operating condition of a component of the climate control system 100. For instance, the controller 40 may change an operating condition of one or both of the compressors 112, 120, and/or blowers 118, 36 such as by activating, deactivating, and/or changing an operating speed of one or both of the compressors 112, 120 and/or blowers 118, 36 during operations. It is understood that this control may include in whole or in part the control of one or more motors associated with the compressors and/or blowers during operations. Similarly, the controller 40 may change an operating condition of one or more of the valves 116, 122, 127 such as by changing a position thereof (e.g., open, closed, or some position therebetween). In some embodiments, the controller 40 may change an operating condition of one or both of the compressor 112, 120 and/or one or more of the valves 116, 122, 127 so as to achieve or maintain a desired temperature in the chamber 12 or other setpoint, e.g., a temperature at the interstage heat exchanger 114.

The controller 40 may also be coupled to one or more sensors 128. This may include a sensor associated with conditions of the chamber 12, the airflow 50, the interstage heat exchanger 114, the condenser 110, the evaporator 124, and/or other components. These sensors may monitor any parameter, for example sensors 128 may be temperature sensors monitoring the temperature of a given component or fluid flow. In other examples, the sensors 128 may be pressure sensors to monitor the respective pressures. Still other sensors and sensor locations may be utilized in accordance with the features described herein.

In the example depicted in FIG. 3, the climate control system includes four different sensors 128(A, B, C, and D). In this example, sensor 128A may be located on the interstage heat exchanger 114. In some examples 128A is a temperature sensor and positioned in a location to monitor the refrigerant in both refrigerant circuits (113 and 121. This configuration allows sensor 128A to monitor the thermal transfer between these two refrigerant flows, and potentially other characteristics as well, e.g., phase change, saturation temperatures, etc. In some examples, this sensor is located in a manner that allows the sensor to confirm whether one or both of the refrigerant fluids undergo a complete or substantially complete phase change. For example, the conditions associated with the refrigerant in the first circuit 113 may be very different when the refrigerant in the second circuit 121 is circulating than in conditions when the refrigerant in the second circuit 121 is not circulating. Thus, sensor 128A may be directed to monitoring the thermal properties of the interstage heat exchanger effected by both of these circuits. This design may allow sensor 128A to monitor an equilibrium state where heat is transferred between the two circuits at a constant or substantially constant state. And some cascade systems are designed for this equilibrium state to occur at certain phase change temperatures in each circuit to provide high levels of performance.

Similar, sensor 128B may be located in the chamber 12, and in some examples, this sensor may be a temperature sensor. In some examples, sensor 128B is located in a manner to provide a consistent temperature reading for the chamber overall (or a sub-compartment thereof). For example, sensor 128B may be located away from a door or seal, or at another location this not subject to frequent temperature variations.

Similar, sensor 128C may be located in the suction duct 32. This sensor may be a temperature sensor and it may provide a consistent temperature associated with the chamber. For example, monitoring the air in the suction duct may aggregate the loads associated with chamber to provide a representative temperature of the chamber overall. In some examples, a sensor (not shown) is provided in the discharge duct 34 to provide a consistent temperature associated with the air being provided to the chamber. In examples with a sensor in both the discharge and the suction ducts, differential parameters may be monitored. For example, the differential temperature may be determined, which in some examples, may be used as part of a load calculation. Differential pressure may also be determined (or other parameters). It is understood that in systems that do not involve forced air, e.g., systems using a different thermal transfer fluid such as some cold wall systems, chillers, etc., the depicted sensor 128C (and similar sensors) may monitor the parameters associated with those fluids.

Sensor 128D in the depicted examples is located at the condenser 110 in the first stage 102. In some examples, this sensor may also be a temperature sensor and it may be used to monitor the conditions associated with the heat source/sink used for the overall system. In some examples, this sensor is used to monitor the conditions of the refrigerant in the first circuit 113, potentially to determine the saturation temperature, phase change associated with the refrigerant through the condenser, or for another purpose.

Sensor 128E in the depicted examples is located at the evaporator 110 in the second stage 104. In some examples, this sensor may also be a temperature sensor and it may be used to monitor the conditions associated with the conditioning heat exchanger associated with the system. In some examples, this sensor is used to monitor the conditions of the refrigerant in the first circuit 113, potentially to determine the saturation temperature, phase change associated with the refrigerant through the condenser, or for another purpose. Further, for each of these sensors 128 it is understood that the sensor may be used to monitor different parameters. For example, for several of the sensors discussed herein pressure sensors may be utilized to provide provided similar indications of how the system is functioning, and in some examples, these pressure measurements may be used to provide proximations of temperature measurements and vice versa.

The controller 40 may be communicatively coupled to the various sensors 128 and may be configured to control an operating condition of the climate control system 100 (or a component thereof) based at least in part on an output from the sensor 128 during operations. For example, the controller 40 may adjust the operation of the first and/or the second compressor (112 and 120, respectively), or the motors thereof, based on the output of one or more of the sensors 128. Specifically, the controller 40 may activate or adjust the operating of the compressors 112, 120 and blowers 36, 118 so as to circulate the first and second refrigerants through the first refrigerant circuit 113 and second refrigerant circuit 121, respectively, as previously described, at least partially in response to an output from the sensor 128 that is indicative of a sensed condition compared to a target value. Conversely, the controller 40 may deactivate the compressors 112, 120 so as to cease circulation of the first and second refrigerant through the first refrigerant circuit 113 and second refrigerant circuit, respectively, as previously described at least partially in response to an output from the temperature sensor 128 that is indicative of a temperature in the suction duct 32 being below a target value. In addition, the controller 40 may adjust a position of the valves 116, 122 and/or or an operating speed of the compressors 112, 120 and/or blowers 36, 118 so as to actively change a cooling capacity of the climate control system 100 based at least in part on an output from the temperature sensor 128.

Figure 4:
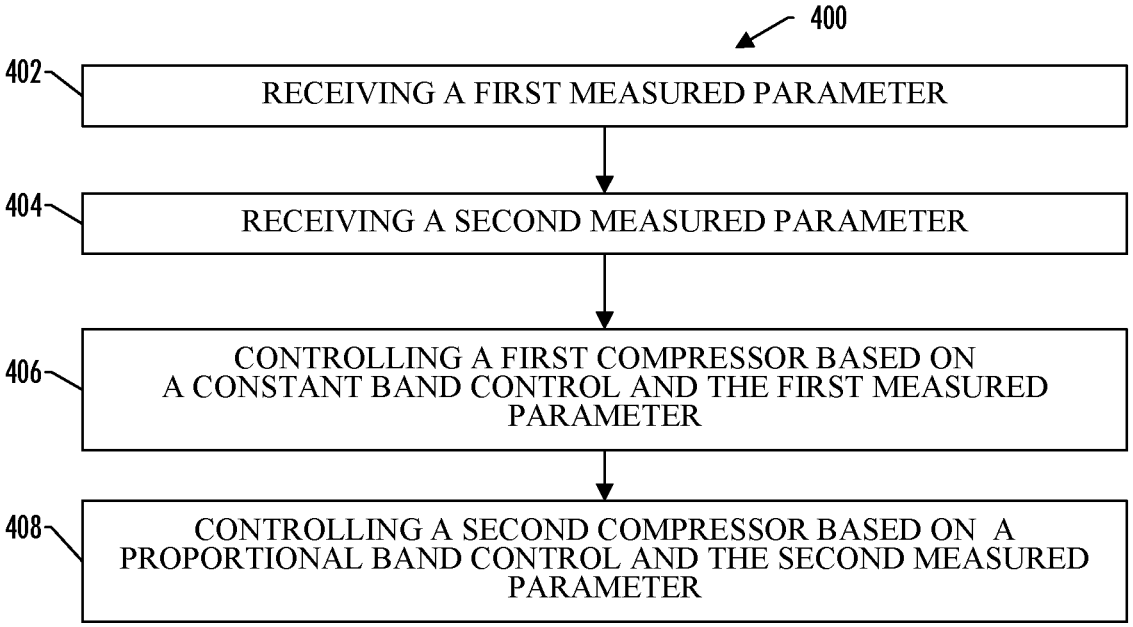
FIG. 4 is a flow chart illustrating various steps of controlling motor(s) of a climate control system, according to various example implementations

Returning to the disclosed control process(es), FIGS. 4-6 provide an overview of the example process(es) that may be used in accordance with the disclosure herein. In some examples, these processes are performed by the climate control systems discussed above in connection with FIGS. 1-3, e.g., the freezer 10. In these examples, the controllers, processes, computer-readable medium, etc., may utilize the various inputs discussed in these processes to control the various components in the manner described herein.

Figure 5A:
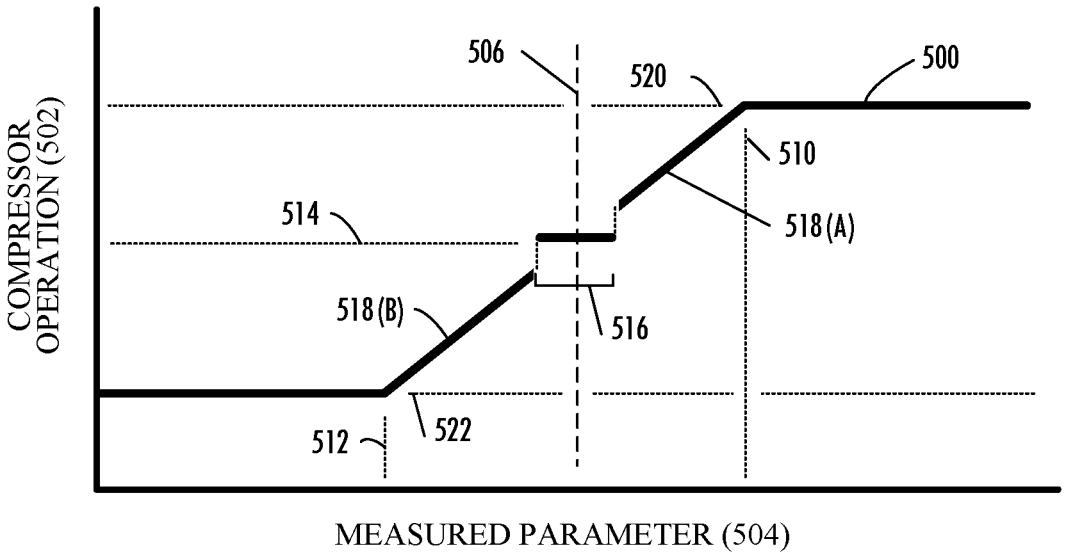
FIG. 5A illustrates a diagram for an example constant band control process, according to some example implementations.
Figure 5B:
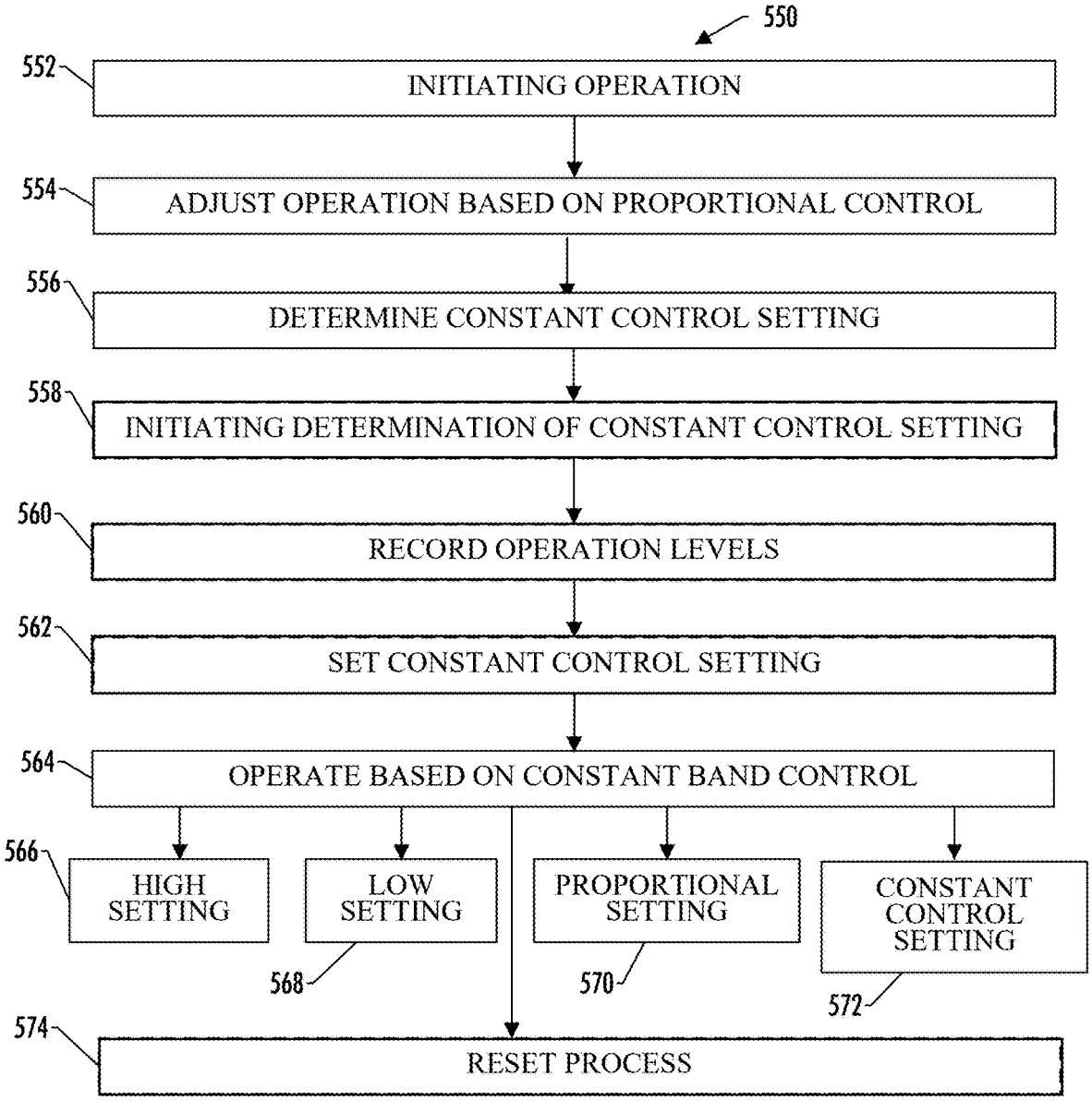
FIG. 5B illustrates a flow chart for an example constant band control process, according to some example implementations.
Figure 6A:
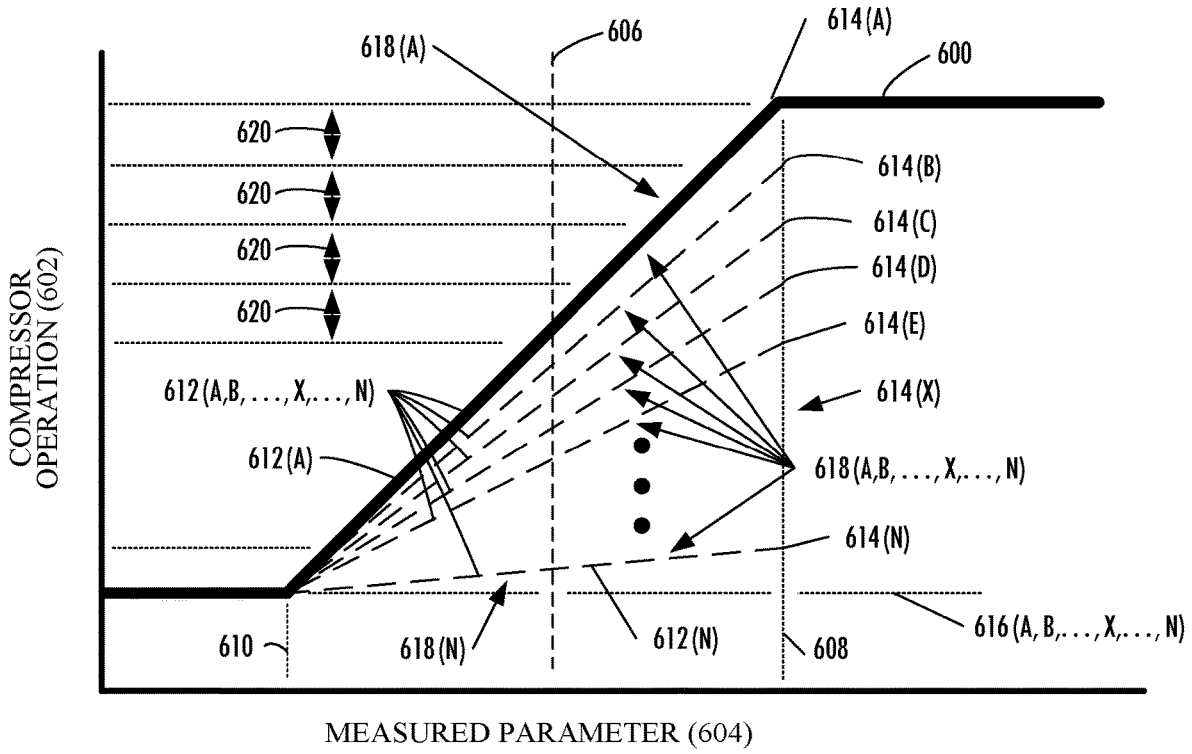
FIG. 6A illustrates a diagram for an example proportional band control process, according to some example implementations.
Figure 6B:
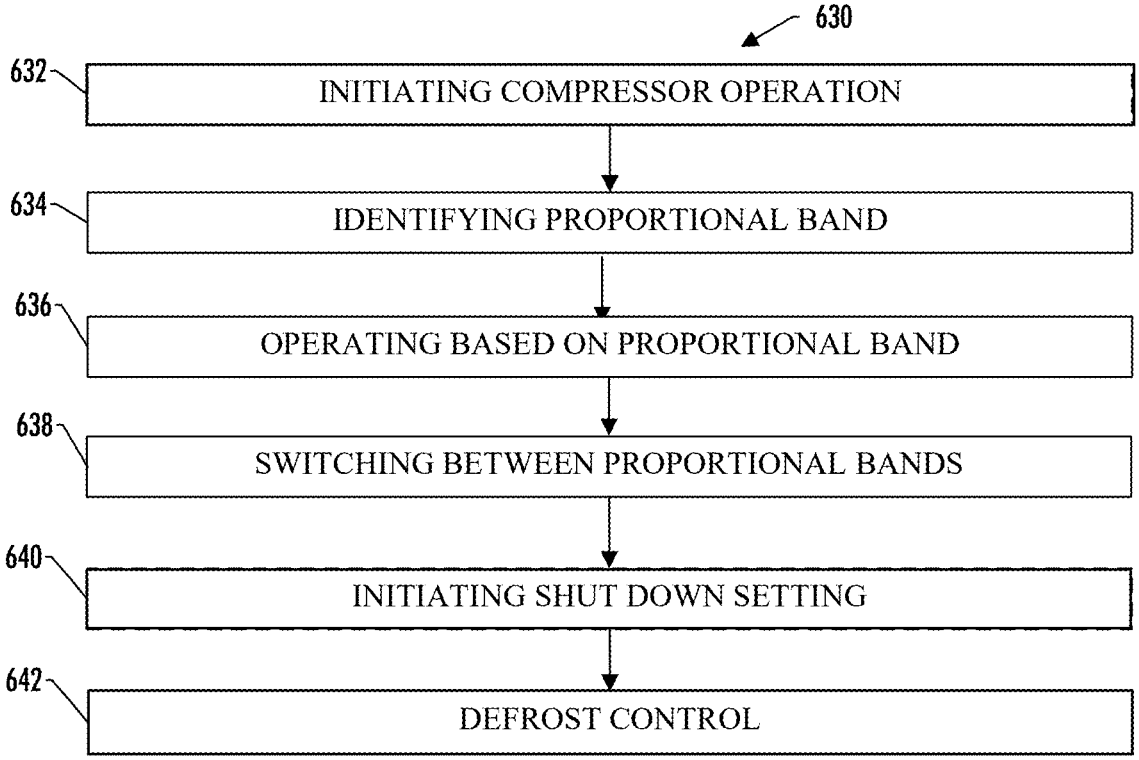
FIG. 6B illustrates a flow chart for an example proportional band control process, according to some example implementations.

FIG. 4 provides an overview of a process 400 that may be used to control two sperate compressors, potentially compressors of a cascade vapor compression system, using two separate control processes. In this example, the first control process is a constant band control process, and the second control process is a proportional band control process. FIGS. 5A and 5B provide a more detail description of an example constant band control process 500 that may be used alone or in combination with process 400. Similarly, FIGS. 6A and 6B provide a more detailed description of an example proportional band control process 600 that may be used alone or in combination with process 400.

Turning to FIG. 4, the process 400 in this depicted example may be applicable to cascade vapor compression systems. For example, the cascade vapor compression system may include a first stage compressor that circulates a first refrigerant in a first stage refrigerant circuit. It may also include a second stage compressor that circulates a second refrigerant in a second stage refrigerant circuit. This may be the same or similar to the process discussed above in connection with FIGS. 1-3. In these examples, there may be advantageous to controlling the first and second stage compressors differently. Thus, the depicted example involves receiving two different measured parameters, and using these measured parameters to control the two different compressors associated with the cascade vapor compression system. And again, in this example each of these compressors are controlled using a different control process.

To provide an overview, the process 400 includes receiving a first measured parameter as shown in step 402, and a second measured parameter as shown in step 404. The process 400 may further control the first stage compressor based on a constant band control process and the first measured parameter as shown in step 406. It may also include controlling the second stage compressor based on a proportional band control and the second measured parameter as shown in step 408.

Receiving the first measured parameter at step 402 may be performed in various ways. For example, this measured parameter may be a temperature measurement associated with an interstage heat exchanger in a cascade vapor compression system, or a different measured parameter. These measured parameters may be received via a sensor, and are potentially received over time, typically on a continuous or regular interval basis. In some examples, the first temperature measurements are received via one or more of the sensors discussed above in connection with FIG. 3.

The process 400 may also include receiving a second measured parameter as shown in step 404. This second measured parameter may be a temperature measurement associated with the chamber conditioned by the cascade vapor compression system, or a different measured parameter. Similar to step 402, the second measured parameters may be received via a sensor, and are potentially received over time, typically on a continuous or regular interval basis. In some examples, the second temperature measurements are received via one or more of the sensors discussed above in connection with FIG. 3.

The process 400 further includes controlling a first compressor based on a constant band control as shown in step 406. This controlling step may utilize the measurements received at step 402 as part of this control process, e.g., the first measured parameter. Controlling the compressor via the constant band control may include setting, adjusting, and operating the compressor, via the compressor motor or otherwise, at various different operating levels, which is discussed in greater detail below with reference to FIGS. 5A and 5B.

Process 400 also includes controlling a second compressor based on a proportional band control as shown in step 408. This controlling step may utilize the measurements received at step 404 as part of this control process, e.g., the second measured parameters. Controlling the second compressor via the proportional band control may include setting, adjusting, and operating the compressor, via the compressor motor or otherwise, at various different operating levels, which is discussed in greater detail below with reference to FIGS. 6A and 6B.

FIGS. 5A and 5B show an example diagram and process flow associated with a constant band control process (500). FIG. 5A shows a diagram for an example constant band control process 500, and FIG. 5B shows a process flow for an example constant band control process. Both of these figures are used to illustrate this example process, and in this discussion, the constant band control process 500 is discussed in connection with the first stage of a cascade vapor compression system (102); however, it is understood that this control process may be used with the second stage of the cascade vapor compression system (104), or any other process, e.g., standard refrigerant process, etc.

In FIG. 5A, the depicted diagram illustrates the constant band control process 500 mapping compressor operation to a parameter associated with the refrigerant circuit. In this example, the compressor operation is an operating level shown as the y-axis 502. The constant band control process 500 maps that operating level to a parameter shown as the x-axis 504. In addition, a parameter setpoint 506 is shown, which may be a temperature setpoint of a given component. In this example, the constant band control process 500 adjusts the compressor operating level based on the measured parameter to achieve or approach the desired setpoint. The below walks through this diagram in more detail.

The y-axis 502 in FIG. 5A is representative of the compressor operating level, which may be the operating speed of the compressor, or potentially other parameters, e.g., power level, capacity level, etc. Here the compressor operating level may be a percentage from 0% to 100%. The 100% operation level may be indicative of the rated maximum operating level of the motor associated with the compressor. In some examples, the maximum operating level may be set differently, potentially based on calibrating the compressor and the compressor motor during manufacturing or testing, during installation, or through a different process. It is further understood that other metrics associated with compressor operation may be used, for example actual compressor speed values may be used, e.g., revolutions per minute (RPM) values, or other metrics associated with the rate of the operating level associated with the compressor operation.

The x-axis 504 in FIG. 5A is representative of a measured parameter. In some examples, the measured parameter is a measured temperature and/or pressure. For first stage compressors in cascade vapor compression system the measured parameter may be the measured temperature of the interstage heat exchanger. In the depicted example, the measured parameter values increase along the x-axis. Again, the measured parameter may be other measured temperatures, pressures, or other parameters used to control the compressor, e.g., via the compressor motor, in the manner discussed here.

The setpoint 506 in FIG. 5A is a target value. In some examples, this setpoint may be the desired value for the given measured parameter. For example, the setpoint value may be the desired temperature of the interstage heat exchanger during operation. In some examples, this setpoint value may be determined to maximize the operating efficiency of first stage refrigerant cycle in a cascade system. For example, it may be based on the refrigerants used in the first and second stages, and the various components. For example, the setpoint may be determined to ensure complete or near complete phase change of the first and/or second refrigerant. For example, the setpoint 506 may be the interstage temperature setpoint, and that temperature setpoint may be selected to optimize the thermodynamic heat transfer of the first and the second refrigerant cycles. In some examples, this setpoint may be determined through testing, calibration, or ongoing operation of the climate control system using this process. In some examples, the temperature setpoint may be adjusted, potentially by a manufacturer of the system, an operator of the system, a technician, etc. Other parameters and setpoints may be used, and it is understood that if this control process is used in a different application, e.g., a non-cascade system, other considerations may be used when selecting this operating setpoint.

The constant band control process 500 also may include various different controls. In the depicted examples, the constant band control process 500 includes a high proportional band limit 510, a low proportional band limit 512, a constant control setting 514, a target parameter band range 516, and a proportional rate control 518. In addition, the high proportional band limit 510 corresponds to a high operating limit 520, e.g., a maximum operating limit, and the low proportional band limit 512 corresponds to a low operating limit 522, e.g., a minimum operating limit. Each of these controls may be used to adjust the compressor operating level 502 to achieve the desired setpoint 506, and in this example, the constant band control process 500 utilizes the appropriate control based on the measured parameter, potentially compared with the setpoint.

Walking through these controls the high proportional band limit 510 may be a measurement above the setpoint 506. In some examples, the high proportional band limit may be referred to as a threshold value, potentially a first threshold value. This value may be selected as a value associated with operating the compressor at a high level, potentially at the maximum operating level. In the depicted example, the high proportional band limit is a parameter setting value above the setpoint 506, and the operating level at the high proportional band limit, e.g., the high operating limit 520, is the maximum operating speed of the compressor. In this example, if a measured parameter is at or above the high proportional band limit 510, the constant band control process 500 may operate the compressor at the maximum operating level, e.g., the maximum operating speed.

The low proportional band limit 512 may be a setting or measurement value below the setpoint 506. In some examples, the low proportional band limit may be referred to as a threshold value, potentially a second threshold value. This value may be selected as a value associated with operating the compressor at a low level, potentially at the minimum operating level. In the depicted example, the low proportional band limit is a parameter setting value below the setpoint 506, and the operating level at the low proportional band limit, e.g., the low operating limit 522, is the minimum operating level of the compressor. In some examples, if a measured parameter is at or below the low proportional band limit 512, the constant band control process 500 may operate the compressor at the minimum operating level, e.g., the minimum operating speed. In another example, not shown, the operating level may fall or jump to zero or an off state if the measured parameter falls below or significantly below the low proportional band limit 512.

In some examples, the high proportional band limit 510 and the low proportional band limit 512 are selected based on the setpoint value and a proportional band offset. In these examples, the high proportional band limit 510 may be a value above the setpoint 506 by the proportional band offset, and the low proportional band limit may be a value below the setpoint 506 by the proportional band offset. For example, if the setpoint is −23° C. and the proportional band offset is 5° C., then the high proportional band limit may be −18° C. and the low proportional band limit may be −28° C. Other processes may be used to determine the high and low proportional band limit.

In some examples, if the measured temperature is between the high and low proportional band limit, other control processes are used by the constant band control process 500. Again, in these examples, the constant band control process adjusts the compressor operation in response to a measured parameter to drive the parameter to (or approximately to) the setpoint.

In this example, the constant band control process 500 attempts to drive the compressor operation to the constant control setting 514. At that setting, the constant band control process operates the compressor at a constant setting provided the measured parameter is within an appropriate range of the setpoint 506. For example, the constant band control process 500 may define a constant band range 516 associated with the setpoint 506. This range 516 may be defined based on a band offset value, and the range may be used to define a range of acceptable measured parameters near the setpoint value. For example, the setpoint value may be −23° C. and the constant band offset value may be 1° C. In this example, the target parameter band range 516 may be between −22° C. and −24° C. In these examples, the constant band control process 500 may control the compressor to operate at the constant control setting 514 when the measured parameter is within the target parameter band range 516. For example, the constant control setting 514 may be a constant speed setting, and the constant band control process 500 may operate the compressor at the constant speed setting when the measured parameter is within the target parameter band range, which in this example is between −22° C. and −24° C.

In some examples, the target parameter band range 516 may also be used to determine the constant control setting 514. This set operating level may be established in various manners, for example, as discussed in more details below, the constant band operating level may be determined based on operating the compressor and assessing the compressor operation in order to determine an appropriate constant control setting. This determining process may be based on the compressor's initial operation during start-up. And in some examples involving cascade vapor compression systems, this determining process may occur after start-up when both compressors are circulating refrigerant through the interstage heat exchanger. Other methods may be used to set this constant control setting as well.

The constant band control process 500 may also utilize other control processes when the measured parameter is within the high and low proportional band limits but outside the target parameter band range 516. In the depicted example, a proportional rate control 518 is shown. That control 518 may be used to adjust the operating level of the compressor based on the measured parameter being either above or below the target parameter band range 516. In some examples, the proportional rate control 518 is used to adjust the operating level of the compressor based on the various proportional processes. In some examples, the proportional rate control 518 may include multiple controls. For example, a different control may be used when the measured parameter is above the setpoint 506, e.g., 518A, then when the measured parameter is below the setpoint 506, e.g., 518B. In some examples a different rate control is used before the constant control setting 514 is determined.

The proportional rate control 518 may use various proportional processes. These processes may be used to proportionally adjust the operating level based on the measured parameter and a proportional factor, e.g., a constant value used to determine the rate of proportional adjustment. For example, the operating level may be determined by interpolating an operating level based on the minimum operating level, the maximum operating level, and a proportional factor. In these examples, the measured parameter 504 may be used, and the process may determine the relative location of the measured parameter x504 between the high proportional band limit 510 and the low proportional band limit 512. The process may then determine the operating level 502 that corresponds to that location through interpolation, and the proportional factor is a value used to allow for this correlation. In other examples, the proportional rate control 518 may be used as part of a feedback process using a gain value and an error associated with the difference between the measured parameter 504 and the setpoint 506. In these examples, the gain value may be considered the proportional factor, and that proportional factor is multiplied by the error to provide a proportional adjustment term which is then used to adjust the operating level. Again other processes may be used.

To walk through an illustrative example, the proportional rate control 518 may be used to determine an operating level based on interpolation. The below provides an equation (1) that may be used as part of this interpolation:

$$Op.\text{level} = \frac{\text{Max Level} - \text{Min Level}}{\text{High Limit} - \text{Low Limit}} \times (\text{Measured } Para. - \text{Low Limit}) + \text{Min Level}$$

In the above equation (1) "Op. Level" is the operating level, e.g., operating level 502. The "Max Level" and "Min Level" are the maximum and minimum operating levels, e.g., the maximum operating level 520 and the minimum operating level 522. The "Measured Para." is the measured parameter 504, and the "high limit" and the "low limit" are the high and the low limit for this measured parameter, e.g., the high proportional band limit 510 and the low proportional band limit 512.

Further, in the above equation, the proportional factor is shown as the following term:

$$Prop.\text{Factor} = \frac{\text{Max Level} - \text{Min Level}}{\text{High Limit} - \text{Low Limit}}$$

Said another way, in the depicted example, the proportional factor is the slope of the line, e.g., the rise over the run, shown in the proportional rate control 518. In this example, this proportional factor is multiplied by the difference between measured parameter 504 and the low proportional band limit 512. This allows the measured parameter to be used to interpolate between the proportional bands. The relative location of the measured parameter within the proportional band, e.g., between the high and low proportional band limits, is used to determine the corresponding relative operating level between the high and the low operating limits. And the relative operating level value is then added to the minimum operating level to determine the appropriate operating level based on the measured parameter.

It is understood that other similar interpolations processes may be used. For example, comparing the high proportional band limit 510 to the measured parameter may be used to determine a relative location of this measured parameter. Knowing that relative location, the corresponding relative operating level may be determined, which may then be subtracted from the maximum operating level to determine the appropriate operating level based on that measured parameter.

Further, as discussed above, in some examples, a proportional feedback process is used. In these examples, a proportional term may be based on a gain value and error, and that term may be used to adjust the operating level of the compressor. In these examples the error value may be based on the difference between a measured setpoint, e.g., 504, and the measured parameter, e.g., 504. This error value may be multiplied by the gain value, e.g., the proportional factor, to determine the proportional term. That proportional term may be used as feedback to adjust the current operating parameter. Again, it is understood that other proportional controls may be used to adjust the operating level based on the proportional factor 518.

Turning to FIG. 5B, processes for an example constant band control process 500 is described with reference to the diagram discussed above in connection with process flow shown. In the example shown in FIG. 5B, the process flow 550 walks through the steps for the constant band control process 500. These steps include initiating operation as shown in step 552, adjusting the operation based on a proportional control as shown in step 554, determining the constant control setting as shown in step 556, and operating based on the constant band control as shown in step 564. The below walks through this process in more detail, and it is understood that the constant band control process 500 may include more or less of the process steps discussed herein.

In some examples, the process 550 may include initiating the operation of the compressor as shown at step 552. When the compressor is initiated at this step the measured parameter may be above the high proportional band limit 510 which may result in the compressor operating at maximum operating level. In some examples, step 552 includes initiating operation of the cascade vapor compression system after installation, potentially the first start-up of the system after being installed. In other examples, initiating the compressor operation may occur after a reset process, potentially the reset process discussed in connection with step 574. Other processes may also be used.

As the operation continues, the measured parameter may adjust and drop below the high proportional band limit 510, which may cause the process 550 to continue to step 554. In these examples, the constant band control process 500 may control the compressor operating level based on the proportional rate control 518, adjusting the compressor operating proportionally during this stage of operation. For example, the compressor operation may be determined based on the interpolation process discussed above or through another process. In some examples, the measured parameter may move back above the high proportion band limit before moving to step 554. In these examples, the process may adjust between controlling the compressor operating level at an elevated level, e.g., the maximum operating level, if the measured parameter is above the high proportional band limit 510, and adjusting the compressor operation based on the proportional rate control 518 if the measured parameter is below the high proportional band limit 510.

As the compressor continues to operate the measured parameter may continue to adjust, and when the measured parameter is within the target parameter band range 516, the process 550 may determine the constant control setting 514 as shown in steps 556. The determining process may be initiated in various ways as shown in 558, and once initiated, the determining process 556 may include various steps, as shown in 560-564. For example, determining the constant control setting at step 556 may begin by recording compressor operating levels as shown in 560. This recording may start once the measured parameter is within the target parameter band range 516, and it may be done in regular increments, e.g., a recording every second, minute, etc. During this recording process, the constant band control process 500 may continue to control the operating level of the compressor based on the proportional rate control 518 while the measured parameter is within the target parameter band range. This process may continue until the measured parameter exits the target parameter band range.

Once the measured parameter exits the target parameter band range 516, the constant band control process 500 may set the constant control setting 514 based on the recorded information, as shown in step 562. For example, an average compressor operation level (e.g., speed) may be taken during this time, and the constant control setting may be set based on this average. Other processes may be used, e.g., median value, mode value, or more complex processes such as regression analysis may be performed on the recorded operating levels to determine the appropriate constant control setting. Once determined, the constant band control process sets the constant control setting at the determined value, as shown step 562. That set value may be used during subsequent operation of the constant control process.

In some examples, the control band process 550 initiates the process of determining the constant control setting in a first instance, as shown in step 558, and the first instance may last until the constant control setting is set as shown in step 562. For example, the first instance may be the first time the measured parameter enters the target parameter band range 516 after the climate control system has been powered on, or the first time after the compressor has been turned on. In some examples, the first instance ends once the measured parameters are outside the target parameter band range 514. In some examples, the first instance is set to span multiple cycles of the measured temperatures going within and exiting the target parameter band range 514, e.g., it is set to include the first 2 cycles, 3 cycles, etc. In some examples, the first instance spans a period of time after an event, e.g., any time the measured parameters are within the target parameter band range for the first day(s) after the climate control system has been powered on. Other time periods and methods may be used to determine a representative occurrence of the system operating with the target parameter band range, and these representative occurrences may be used to determine the constant control setting as discussed above.

In some examples, the determining process is only initiated at step 558 in a cascade vapor compression system after the first stage compressor and the second stage compressor have both begun circulating refrigerant. This may be advantageous because it may allow the measured parameter to account for the interaction of heat transfer between the stages. For example, if the measured parameter is associated with the interstage heat exchanger, waiting to begin the determining process at step 556 until both the first stage refrigerant and the second stage refrigerant flow through the heat exchanger may allow the measured parameter to account for the properties, e.g., thermal properties, of each of these refrigerants and the interaction between those flows.

Returning to FIG. 5B, once the constant control setting is determined through the process described above (or another means), the constant band control may control the compressor based on the constant control setting as shown in step 564. This process includes operating the compressor at the high level operation, e.g., maximum operating level, if the measured temperature is above the high proportional band limit 510, as shown in step 566. It also includes operating the compressor at the low level operation, e.g., minimum operating level, if the measured parameter is below the low proportional band limit 512, as shown in step 568. The process further includes operating the compressor based on the proportional rate control 518 if the measured parameter is between the high proportional band limit and the low proportional band limit, while also being outside the target parameter band range 516, as shown in step 570. In addition, the process includes setting the compressor operation to the constant control setting if the measure parameter is within the target parameter band range 516 in the second instance, as shown in step 572.

To walk through step 572 further, the second instance may be a time after the constant band setting has been determined and/or set, and the measured parameter is within the target parameter band range. In some examples, the second instance is every time the measured parameter is within the target parameter band range and the compressor is operating after the control setting 514 has been determined and/or set. For example, it may be advantageous in a cascade vapor compression system to operate the first stage compressor at a constant speed setting to provide a consistent heat sink (or source) for the second stage circuit. Other time periods and methods may be used to determine when it is appropriate to operate the compressor at the constant control setting 514 when the measured parameter is within the target parameter band range and the compressor is operating.

The constant band control process 500 may also include a reset process, as shown in step 574. This process may cause the constant control process to redetermine the constant control setting 514. This redetermination process may include some or all of the steps discussed above. This process may be initiated by a user or by a given event, e.g., powering off the climate control system, error(s) messages, diagnostics, etc.

FIGS. 6A and 6B show an example diagram and process flow associated with a proportional band control process (600). FIG. 6A shows a diagram for an example proportional band control process 600, and FIG. 6B shows a process flow for an example proportional band control process. Both of these figures are used to illustrate this example process, and in this discussion, the proportional band process 600 is discussed in connection with the second stage (104) of a cascade vapor compression system; however, it is understood that this control process may be used with the first stage (102) in a cascade vapor compression system, or any other process, e.g., standard refrigerant process, etc.

FIG. 6A shows a diagram of an example proportional band control process 600. As shown in this diagram, compressor operation level 602 is shown on the x-axis, and that operation level is mapped to the proportional band control process 600 based on a measured parameter 604 shown as the y-axis in FIG. 6A. In addition, the proportional band control process 600 also includes a setpoint 606, a high proportional band limit 608, a low proportional band limit 610, and a plurality of proportional bands 612(A, B, C, . . . , N). As discussed in more detail below, each of these proportional bands 612 includes a maximum operating level 614, a minimum operating level 616, and a proportional factor 618. The below walks through these features in more detail.

Similar to the above FIG. 5A, the y-axis 602 in FIG. 6A is representative of compressor operating level, which may be the operating speed of the compressor, or potentially other parameters, e.g., power level, capacity level, etc. Here the compressor operation level may be a percentage from 0% to 100%. The 100% operation level may be indicative of the rated maximum operating level of the motor associated with the compressor. In some examples, the maximum operating level may be set differently, potentially based on calibrating the compressor and the compressor motor during manufacturing or testing, during installation, or through a different process. It is further understood that other metrics associated with compressor operation may be used. For example, actual compressor speed values may be used, e.g., RPM values, or other metrics associated with the rate of the operating level associated with the compressor operation.

Also similar to the FIG. 5A, the x-axis 604 in FIG. 6A is representative of a measured parameter. In some examples, the measured parameter is a measured temperature and/or pressure. In some examples, the measure parameter 604, may be used to control a second stage compressor in cascade vapor compression system, and in that example, the measured parameter may be the measured temperature of the chamber conditioned by the cascade vapor compression system. In the depicted example, the measured parameter values increase along the x-axis. Again, the measured parameter may be other measured temperatures, pressures, or other parameters used to control the compressor in the manner discussed here.

The setpoint 606 in FIG. 6A is a target value, and again, it may be similar to setpoint 506. In some examples, this setpoint may be the desired value for the given measured parameter. For example, in the second stage circuit, the setpoint value may be the desired temperature for a chamber conditioned by the cascade vapor compression system. In some examples, this setpoint value may be set based on user preference, one or more substances within the chamber, e.g., a medical or chemical substance, etc., by another process. In some examples, such as ultra-low storage units, the chamber setpoint may be at −80° C. In some examples, the setpoint may be adjusted, potentially by a manufacturer of the system, an operator of the system, a technician, etc. Other parameters and setpoints may be used, and it is understood that if this control process is used in a different application, e.g., a non-cascade system, other considerations may be used when selecting this operating setpoint.

As shown in FIG. 6A, the proportional band control 600 may also include a high proportional band limit 608 and a low proportional band limit 610. These limits may be used to establish a high limit and a low limit for the proportional bands. In some examples, these limits may be set based on the setpoint 606. For example, the high proportional band limit 608 may be a parameter setting above the setpoint 606. In these examples, the proportional control process 600 may set the operating level to a high operating level, potentially the maximum operating level for a given proportional band 612, when the measured temperature is at or above the high proportional band limit, e.g., a high temperature limit. Similarly, the low proportional band limit 610 may be a parameter setting below the setpoint 606. In these examples, the proportional control process 600 may operate at a low operating level, potentially the minimum operating level for a given proportional band 612, when the measured temperature is at or below the low proportional band limit 610, e.g., a low temperature setpoint.

To walk through an example, the setpoint 606 may be −80° C., which may be set as the desired temperature for a chamber in an ultra-low storage unit. In these examples, the high proportional band limit 608 may be set above the setpoint 606 by a certain amount. In this example the high proportional band limit 608 is set at −78° C., e.g., 2° C. above the setpoint 606, and the low proportional band limit 610 is set at −81° C., e.g., 1° C. below the setpoint 606. In the depicted example, the high proportional band limit 608 and the low proportional band limits 610 are the same for each of the plurality of proportional bands 612; however, as will be appreciated by the below discussion, in some examples each proportional band may have its own high and/or low proportional band limit.

As shown in FIG. 6A, the proportional band control 600 may also include a plurality of proportional bands 612. Again, each of these proportional bands includes a maximum operating level 614, a minimum operating level 616, and a proportional factor 618. The maximum operating level 614 corresponds to the operating level for that given proportional band 612 when the measured parameter is at or above the high proportional band limit 608 for that proportional band. The minimum operating level 616 corresponds to the operating level for that given proportional band 612 when the measured parameter is at or below the low proportional band limit 610 for that proportional band. And the proportional factor 618 is the proportional factor used to adjust the compressor operation level when the measured parameter is between the high proportional band limit 608 and the low proportional band limit 610.

The proportional factor 618 may be used to adjust the operating level between the maximum operating level 614 and the minimum operating level 616 of a given proportional band 612. In some examples, the operating level may be adjusted by the proportional factor in the same manner discussed above in connection with the proportional rate control 518 associated with the constant band control process 500. For example, the operating level may be determined through interpolation and the proportional factor 618 may be used to determine the relative location of the measured parameter within the proportional band. As discussed above, this relative location of the measured parameter may be used to determine the corresponding relative operating level within the proportional band, e.g., the relative operating level between the minimum operating level and the maximum operating level associate with the proportional band. In other examples, also similar to the discuss above, the adjustment process adjusts the operating level based on an error associated with the measured parameter 604 and the setpoint 606 and a gain value, e.g., the proportional factor in these examples. Using this gain and error, the proportional control process 600 may adjust the compressor operation to drive the measured parameter to the setpoint 606. As discussed in more detail below, the proportional band control 600 may switch between these various proportional bands to determine the appropriate control band for the compressor to satisfy a given condition.

In the example depicted in FIG. 6A, the proportional bands 612(A, B, . . . , X, . . . N) are arranged sequentially. In this example, each of the proportional bands includes the same minimum operating level 616, and each of the proportional bands includes a different maximum operating level 614. This example, each maximum operating level 614(X) for a given proportional band 612(X) is less than the successive maximum operating level 614(X+1) for the next proportional band 612(X+1). In some examples, this may continue from a maximum overall operating level, potentially the maximum rated operating level of the compressor, to a minimum rated operating level. In some examples, including the example depicted in FIG. 6A, this successive decrease occurs in regular intervals 620, for example, each successive maximum speed is less than the next maximum speed by a regular amount, e.g., decreases by 5%, 100 RPMs, etc.

To walk through an example, the maximum operating level for a first proportional band may be 100% of the rated speed for a given compressor, and the minimum overall operating level for that compressor may be 30% of the rated speed. In this example, the minimum operating level remains the same for all the proportional bands, and the maximum operating level decreases for each successive operating level. Here the first proportional band 612(A) has a minimum operating level 616(A) of 30% of the rated speed and a maximum operating level 614(A) of 100% of the rated speed. The next successive proportional band 612(B) has a minimum operating level 616(B) for 30% of the rated speed, but the maximum operating level 614(B) reduced by a regular amount. In this example, the regular amount is 5%, and so the maximum operating level 614(B) is 95% of the rated speed for the second proportional band 612(B). In this example, this process continues, e.g., the third proportional band 612(C) has a minimum operating level 616(C) of 30% of the rated speed and a maximum operating level of 90% of the rated speed, and so forth for 612(D), 612(E), etc. In this example, the proportional bands continue until the maximum operating level of a given proportional band is at or approximately at the minimum operating level for that given proportional band. Again, in this example, after 13 successive operating bands the maximum operating level of the proportional band will be 35% of the rated speed and the minimum operating level will be 30% of the rated speed. In some examples, that may be the last proportional band in this example control process. In other examples, there may be another proportional band 612(X) where the minimum operating level 616(X) and the maximum operating level 614(X) are the same value.

It is understood that the above is just one example of how the various proportional bands may be configured for the plurality of proportional bands used in a proportional band control process. For example, the maximum operating level 614 may remain constant for each of the proportional bands 612, and the minimum operating level 616 may increase, potentially by regular amounts. In some examples, both the maximum operating level and the minimum operating level each are adjusted for each proportional band. In some examples, the maximum operating level 614 and/or the minimum operating level are adjusted based on a multiplier and/or other factors. Still other examples may be utilized.

Further, as discussed above, each proportional band 612 may also include a proportional factor 618. The proportional factor 618 may be the same or similar to the proportional factor discussed above in connection with the proportional rate control 518 used as part of the constant control process 500. Similar to that control, the proportional factor 618 in the proportional band control process 600 may be used to determine the rate of adjustment for the operating level when the measured parameter 602 is within a given proportional band 612. For example, the proportional factor 618 may be used to determine the relative location of the measured parameter and the corresponding operating level within the band based on interpolation. In other examples, the proportional control process 600 may compare the measured parameter 602 at a given time to the setpoint 606 to determine an error value. That error value may be adjusted based on the proportional factor 618, e.g., the gain, to adjust the operating level of the compressor to drive the measured parameter towards the setpoint. In some examples, this adjustment of the compressor operating level may be bound by the minimum and maximum compressor operating level for a given proportional band, e.g., the operating level will not exceed the maximum operating level for a given proportional band or run below the minimum operating level for the given proportional band.

In addition, as discussed above, these proportional factors 618 may be different for each proportional band 612. Adjusting the proportional factors for the proportional bands has various advantages. For example, using a proportional factor allows for adjustments to the operating level, however, this process can also lead to various issues, e.g., overshoot, oscillation, etc. Thus, proportional factor values are often selected for a given system to maximize the benefits and limit the issues for that system. For example, larger proportional factors may lead to increased response times to errors and drive the system towards a setpoint faster. However, this speed may come at the cost of increased undesirable issues, e.g., overshoot, oscillation, etc. In contrast, a lower proportional factor decreases these undesirable issues but may lead to slower response times. As a result, allowing the system to switch between multiple proportional bands allows the disclosed control process to refine the proportional factor to a value that is appropriate for the given system and/or the conditions being addressed by the system.

In some examples, the proportional factor 618 is the only adjustment being used by the proportional band control process 600. For example, each proportional band in the proportional band control process may not include an integral error term and/or a derivative error term. Thus, in some examples, the adjustment process is only using a proportional error term, and potentially adjusting between the different gains. Thus, in some examples, the adjustment process is not a proportional and integral process, e.g., not a PI process, nor is the adjustment process using a derivative error term, e.g., it is not a PID process. Rather, in some examples, the proportional band control process 600 is only using a proportional process, e.g. only a P process, to adjust the error. In these examples, the process 600 may switch between a variety of different proportional processes with different proportional factors to adjust and refine the control process to achieve the setpoint in a fast and reliable matter.

Returning to FIG. 6A, the proportional factors 618(X) for each proportional band 612(N) in the depicted example are each determined based on the maximum operating level 614(N) and the minimum operating level 616(X) for that proportional band. For example, in the depicted example, the proportional factor 618(X) for each proportional band 612(X) is based on the slope of the line for the given proportional band. Said another way, in this example, the proportional factor 618(X) is set as the rise over the run for the proportional band 612(X) shown. Thus, in this example, the proportional factor 618(X) is the maximum operating level 614(X) minus the minimum operating level 616(X), e.g., the rise, over the high proportional band limit 608 minus the low proportional band limit 610, e.g., the run. As a result, in the depicted example, because the successive maximum operating levels decrease, the proportional factor also decreases for each successive operating level. This configuration may be advantageous because the proportional bands continue to narrow the operating range, and also decrease the proportional factor. As a result, the depicted proportional control process 600 provides a process of continuing to refine the control to identify both an optimum range of compressor operation, along with the appropriate control rate to allow the compressor operating level to be adjusted promptly, which limits the undesirable results from incorrect proportional factors or other control processes.

To walk through an illustrative example, an adjustment process using interpolation is described. In this example, the proportional bands are also arranged sequentially such that the minimum operating level 616(X) remains the same for each proportional band, and the maximum operating level 614(X) decreases by a given amount. In addition, the proportional factor 618(X) is adjusted based on the corresponding adjustment to the maximum operating level. In this example process, the measured parameter is between the high proportional band limit 608 and the low proportional band limit 610. As a result, the proportional factor 618(X) is used to interpolate the given proportional band 612(X) and find the relative location of the operating speed that corresponds to the relative location of the measured parameter within that band. The proportional band process continues to adjust the operating speed based on the updated measured parameter and this interpolation process associated with the given proportional band 612(X). However, if that proportional band is unable to move the measured parameter to the setpoint, then the proportional control process may switch to a different proportional band, e.g., 612(X+1), to adjust the operating level based on the measured parameter. Because the different proportional band, e.g., 612(X+1), includes different values, e.g., a different proportional factor and a different maximum speed, the updated proportional band adjusts the operating level differently based on the same measured parameter. For example, the updated proportional band 612(X+1) will interpolate the measured parameter to correspond to a different operating level because the corresponding operating level in this updated proportional band 612(X+1) is based on a different proportional factor 618(X+1) with a different range between the maximum operating level 614(X+1) and the minimum operating level 616(X+1). As a result, this updated proportional band 612(X+1) may be better able to adjust the operating level 602 based on the measured parameter 604 to achieve the setpoint 606. If the updated proportional band does not perform adequately then the process continues to switch between the various proportional bands 612 to determine the proportional band 612 that does adjust the operation appropriately for the system and the conditions.

Turning to FIG. 6B, an example process flow 630 is shown that walks through various steps that may be used as part of the proportional band control process 600. This process flow is discussed with reference to the various controls discussed above in connection with FIG. 6A.

As shown in the example depicted in FIG. 6B, the process includes initiating compressor operation, as shown in step 632. The process further includes identifying the appropriate proportional band control, as shown in step 634, and operating the compressor at the identified proportional bands, as shown at step 636. The process further includes switching between the plurality of proportional bands, as shown at step 638. As discussed in more detail below, the process includes various processes for switching between these bands. The process may further include identifying a shut down setting, as shown at step 640, and the process may also include a defrost control, as shown at step 642. It is understood that the proportional band control 600 may include more or less of these process steps.

To walk through these process steps in more detail, the proportional band control process 600 may begin when the compressor is initiated as shown in step 632. In some examples, this may occur when a climate control system is turned on, and the compressor may be initiated at that time. In other examples, potentially for a second stage compressor in a cascade vapor compression system, the compressor may be initiated at step 632 after an event has occurred, e.g., after the interstage heat exchanger reaches a certain temperature. Other examples or events may cause the compressor to initiate, some of which are discussed herein.

Once the compressor is initiated, the proportional band control process 600 includes identifying the appropriate proportional band control as shown in step 634. For example, if the system is being turned on for the first time, or after some period of time, the proportional band control process 600 may start the process at the first proportional band, potentially the proportional band with the highest operating level, e.g., proportional band 612(A) shown in FIG. 6A. In other examples, the compressor may begin operation as the result of a given event or other operation, and a different proportional band may be identified. This may include identifying the last proportional band used by the proportional band control process 600, or identifying a proportional band above or below the last proportional band used by the proportional band control process 600. Further examples are discussed below, and the disclosed process contemplates further implementations.

The proportional band control process 600 also includes operating the compressor at a given operating level, as shown in step 636. If the compressor has just been initiated, the proportional band control process 600 may be operating the compressor at the proportional band 612 identified in step 634. If the compressor has been operating for some time, the proportional band control process 600 may have switched between various proportional bands, as discussed below in connection with step 638. And in those examples, the proportional band control process 600 will operate the compressor based on the current proportional band identified based on the switching. Regardless, in some examples, the proportional band 612 used to operate and adjust the operation of the compressor may be referred to as the operating proportional band.

In some examples, the proportional band control process 600 may operate the compressor based on the operating proportional band 612(X) as follows. If the measured parameter 604 is above the high proportional limit 608, then the proportional band control process may operate the compressor at the maximum operating level 614(X) for the operating proportional band 612(X). If the measured parameter 604 is between the high proportional band limit 608 and the low proportional band limit 610, then the proportional factor 618(X) for the operating proportional band 612(X) is used to adjust the operation of the compressor. As discussed above, this may include determining the relative location of the measured parameter within the proportional band, and then applying the proportional factor 618(X) to that location to determine the appropriate adjustment to the operating level of the compressor. This adjustment to the operating level may be bound by the minimum operating level 616(X) and the maximum operating level 614(X) for the operating proportional band 612(N). For example, the adjustment based on the proportional factor 618(X) may be limited to reducing the operating level of the compressor to no less than the minimum operating level 616(X) or increasing the operating level of the compressor to no more than the maximum operating level 614(X).

In some examples, the proportional band process 600 may also initiate the shut down process discussed below in connection with step 640 below if the measured parameter 604 is below the low proportional band limit 610. In other instances, if the measured parameter 604 is below the low proportional band limit 610, then the proportional band control process may operate the compressor at the minimum operating level 616(X) for the operating proportional band 612(X). In these instances, the low proportional band limit 610 may be a different setpoint than the shut off condition.

Further, in some examples, the proportional band control process 600 also includes switching between the plurality of proportional bands, as shown in step 638. In some examples, the switching between the plurality of proportional bands includes switching from a given proportional band 612, potentially referred to as a first or previous proportional band, to a proportional band with either a higher or a lower maximum operating level. For example, the proportional band control process 600 may switch to a proportional band with a higher maximum operating level if a given proportional band 612 is unable to achieve a measured parameter 604 equal to or less than the setpoint 606. Or in some examples, it may switch between proportional bands if a given proportional band 612 is unable to achieve a measured parameter 604 equal to or less than the high proportional band limit 608 within a set interval of time. Conversely, the proportional band control process 600 may switch to a proportional band with a lower maximum operating level if a given proportional band 612 is unable to achieve a measured parameter 604 equal to or more than the setpoint 606 (or the low proportional band limit 610) within a set interval of time. Other similar types of switching may be performed.

To walk through a further example of this switching shown in step 638, the example depicted in FIG. 6A is used. As discussed above, in this example, the proportional band control process 638 includes a plurality of proportional bands where each successive proportional band 612(X) includes the same minimum operating level 616(X) and a lower maximum operating level 614(X) than the previous proportional band 612(X−1). In addition, the proportional factor 612(X) for the proportional band 612(X) is also reduced for each successive proportional band 612(X+1), and this reduction is based on the reduction of the maximum operating level 614(X).

In this example, the proportional band control process 600 may switch from a given proportional band 612, potentially a first or previous proportional band, to an operating proportional band 612 in response to a given event. In this example, the event may be that operating the compressor based on the given proportional band 612(X) has failed to drive the measured parameter 604 to the setpoint 606 within a set interval of time. As a result, if the measured parameter 604 is constantly above the setpoint 606 for a set period of time, e.g., the measured parameter fails to achieve or go below the setpoint for the set period of time, then the process may switch to a proportional band with a greater maximum operating level. Again, using the plurality of proportional bands shown in FIG. 6A, the process may switch from a previous proportion band 612(X) to an operating proportional band 612(X−1) where the maximum operating level is increased by 5%. However, continuing with this example, if the measured parameter 604 is constantly below the setpoint 606 for a set period of time, e.g., the measured parameter fails to achieve or go above the setpoint for the period of time, then the process may switch to a proportional band with a lower maximum operating level. Thus, here, the process 600 may switch from the first or previous proportional band 612(X) to an operating proportional band 612 (X+1) where the maximum operating level is decreased by 5%. It is understood that this switching process may continue multiple times to continue to drive the system to an appropriate proportional control band for a given system and/or condition. It is also understood that the values may be different and other factors and/or setpoints may be used when determining whether to switch between the plurality of proportional bands.

Further, the set period of time may be any period of time suitable for the system being controlled. For example, it may be shorter period of time, e.g., 10 mins, 20 mins, etc., or longer periods of time, e.g., 1 day, 2 days, etc. Further, the set period of time may be the same when determining whether to switch to a higher level proportional band or to a lower level proportional band, and in other examples, these periods of time may be different. In some examples, this period of time starts at any point where the measured parameter 604 is not at the setpoint 606. For example, this period of time may begin once the system switches to a given proportional band, which typically occurs because the measured parameter 604 is not at the setpoint 606. Or in some examples, this period of time starts after the measured parameter 604 is at the setpoint 606 and then deviates from that setpoint for some reason, e.g., change in load, component issue, etc. In these instances, the setpoint 606 may have a tolerance level, e.g., 0.1° C., and once the measured parameter is outside of that setpoint, e.g., measured −79.9° C., then the period of time may begin. And, in some examples, once the period of time begins it may continue until it is reset or expires.

Further, in some examples, the period of time may only be reset based on certain conditions. For example, the period of time may only resets if the measured parameters 604 achieves the setpoint 606, and the period of time may not reset if the measured parameters 604 deviates outside of the proportional band limits, e.g., below the high proportional band limit 608 and/or above the low proportional band limit 610. To walk through an example, the process 600 may be at a given proportional band 612(X) and the measured parameters 604 may be above the setpoint 606. As a result, the process 600 may start a timer to determine if the set period of time will elapse causing the process 600 to switch to a different operating proportional band. At this time, the measured temperature may be above the high proportional limit 608, and as a result, the compressor may be operating at the maximum level for the given proportional band 612(X). As the operation of the compressor continues (and the timer continues) the measured parameters may decrease below the high proportional band limit 610, which will lead to the proportional band control process 600 reducing the compressor operation based on the given proportional factor, e.g., 618(X). However, in some examples, this decrease in compressor operation with not cause the period of time to reset, rather the timer continues. In this example, the timer continues until either the measured parameter 604 achieves the setpoint 606, in which case, the timer resets and the process 600 continues to operate the compressor based on the given proportional band, e.g., 612(X). Or the timer expires, e.g., reaches the period of time, then the process 606 switches to a different proportional band, which in this case would be a proportional band with a higher maximum operating level and the timer for the proportional band will run in the same manner.

In some examples, the proportional band control process 600 further includes a shut down setting, as shown in step 640. For example, the process 600 may include a setting that causes the compressor to shut down, and in some examples, potentially for examples directed to cascade vapor compression system, the setting may lead to both the first stage compressor and the second stage compressor shutting down. In these examples, the shut down setting may be triggered when the measured parameters 604 are at or below a certain level, potentially below the low proportional band limit 610 or other shut down condition. For example, if the measured parameter is a temperature of a chamber conditioned by a cascade control system, and the setpoint is the desired temperature for the chamber, e.g., −80° C., then the shut down condition, which in this example is the low proportional band limit, may be a temperature that is below the chamber setpoint by a given amount, e.g., 1° C. In these examples, if the measured temperature of the chamber is less than −81° C. then the process 600 may shut down one or more of the compressors of the cascade vapor compression system. For example, the process 600 may shut down the second stage compressor, and potentially the first stage compressor, in response to the measured temperature of the chamber being −81° C. or less. In some examples, this shut down condition (and potentially the corresponding shut down setting) may be the same for all the proportional bands, e.g., the shut down setting may be triggered if the shut down condition is meet regardless of which proportional band is governing the operation of the compressor at the time. It is further understood that other conditions or multiple conditions may be used as the shut down condition. For example, the above example may also include a timer, and the shutdown setting is only activated if the shut down setting is achieved for a certain amount of time. In some examples, the shut down setting may be triggered when excess pressure deviations occur or other fault conditions.

In these examples, the proportional band control process 600 may adjust the operating proportional band 612 once compressor operation is restarted after the shut down condition occurs. To continue using the above example, in the event one or more of the compressors are shut down for a cascade vapor compression system because the measured chamber temperature is at or below −81° C., when the system restarts, the proportional band control process 600 may switch to a lower proportional band 612 as the operating proportional band. For example, if the shut down condition occurs while the compressor is operating a given proportional band, 612(X), then upon restart, the process 600 may switch to controlling the compressor at the next proportional band 612(X+1) where the maximum operating speed is lower. Again, other processes may be used and adjustments may be used as well.

In some examples, the proportional band control process 600 further includes a defrost control, as shown in step 642. In these examples, the system using the proportional band control process 600 may include a defrost setting, e.g., the system may be a climate control system. In these examples, the defrost setting may result in a change in operating for one or more of the components of the climate control system, and this process is typically directed to removing ice from one or more of the heat exchangers. In these examples, the defrost setting may override the proportional band control process 600 while the defrost process is necessary. However, once the defrost process is completed, the proportional band control process 600 may resume control over the compressor, and in these examples, the proportional band control process 600 may select the last proportional band 612 used for the control process. For example, the proportional band control process 600 may have been used as discussed above, and it may (or may not) have switched between various proportional bands 612. As a result, in this example, when the defrost process is initiated the proportional band 612(X) is being used to control the compressors operating level. Once the defrost process is concluded, the proportional band control process 600 then resumes controlling the compressor based on the proportional band 612(X) which was previously used.

Figure 7:
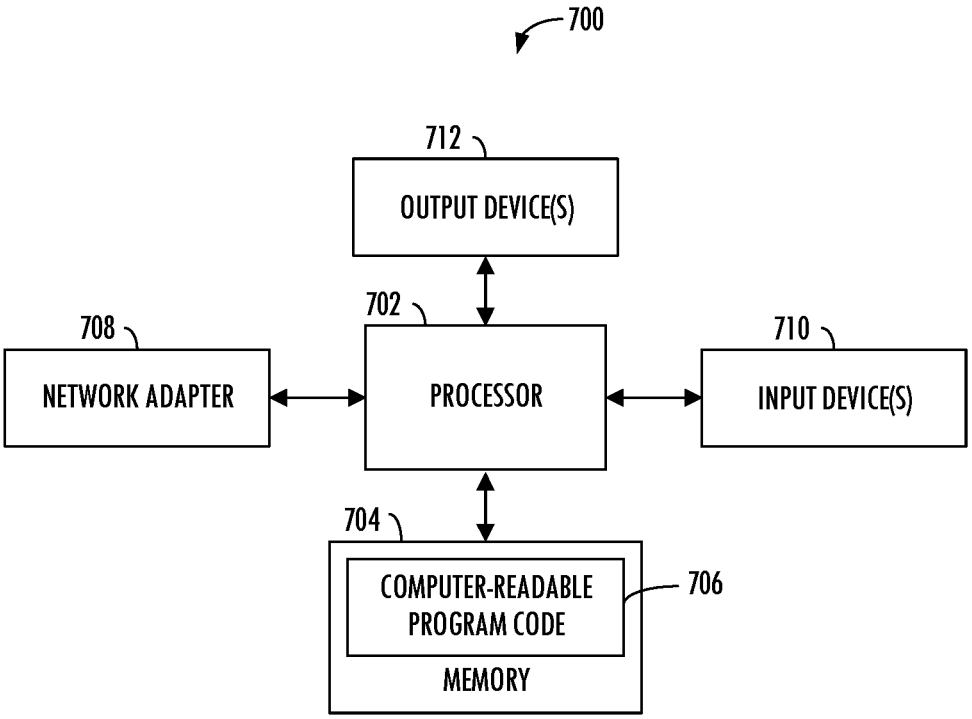
FIG. 7 illustrates control circuitry according to some example implementations.

FIG. 7 illustrates an apparatus 700 according to some example implementations of the present disclosure. Generally, an apparatus of exemplary implementations of the present disclosure may comprise, include or be embodied in one or more fixed or portable electronic devices. Examples of suitable electronic devices include any of the controllers, processors, or other electrical devices discussed herein, and to the extent not already discussed: smartphone, tablet computer, laptop computer, desktop computer, workstation computer, server computer, PLC, circuit board or the like. The apparatus may include one or more of each of a number of components such as, for example, a processor 702 connected to a memory 704.

The processor 702 is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor may be a number of processors, a multi-core processor or some other type of processor, depending on the particular implementation.

The processor 702 may be configured to execute computer programs such as computer-readable program code 706, which may be stored onboard the processor or otherwise stored in the memory 704. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 704 is generally any piece of computer hardware capable of storing information such as, for example, data, computer-readable program code 706 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 702, causes the apparatus 700 to perform various operations as described herein, some of which may in turn cause the components discussed herein to perform various operations.

In addition to the memory 704, the processor 702 may also be connected to one or more peripherals such as a network adapter 708, one or more input/output (I/O) devices or the like. The network adapter is a hardware component configured to connect the apparatus 700 to one or more networks to enable the apparatus to transmit and/or receive information via the one or more networks. This may include transmission and/or reception of information via one or more networks through a wired or wireless connection using Wi-Fi, Bluetooth, BACnet, LonTalk, Modbus, ZigBee, Zwave, or the like, or other suitable wired or wireless communication protocols.

The I/O devices may include one or more input devices 710 capable of receiving data or instructions for the apparatus 700, and/or one or more output devices 712 capable of providing an output from the apparatus. Examples of suitable input devices include a keyboard, keypad or the like, and examples of suitable output devices include a display device such as a one or more light-emitting diodes (LEDs), a LED display, a liquid crystal display (LCD), or the like.

As explained above and reiterated below, the present disclosure includes, without limitation, the following example implementations.

Clause 1. A method of controlling a cascade vapor compression system, the cascade vapor compression system including a first stage compressor configured to circulate refrigerant in a first stage refrigeration circuit, and a second stage compressor configured to circulate refrigerant in a second stage refrigeration circuit, the method comprising: receiving first measurements over time indicative of a first parameter associated with the cascade vapor compression system; receiving second measurements over time indicative of a second parameter associated with the second stage refrigeration circuit; controlling a speed of the first stage compressor based on a constant band control, wherein controlling the first stage compressor based on the constant band control includes: operating the first stage compressor at a constant speed setting upon determining that the first measurements are within a target parameter band, wherein the target parameter band is defined by a first setpoint and a band offset, and adjusting the speed of the first stage compressor based on a proportional rate control upon determining that the first measurements are outside the target parameter band and within a first threshold and a second threshold; and controlling a speed of the second stage compressor based on a proportional band control, wherein controlling the speed of the second stage compressor based on the proportional band control is based on, in part, the second measurements and a second setpoint, the proportional band control further including a plurality of proportional bands, each of the plurality of proportional bands including a different proportional factor than any other proportional band in the plurality of proportional bands.

Clause 2. The method of any of the clauses, wherein controlling the speed of the second stage compressor based on the proportional band control further includes: identifying an operating proportional band from the plurality of proportional bands, each of the plurality of proportional bands including a maximum operating speed, a minimum operating speed, and the proportional factor, and adjusting the speed of the second stage compressor based on the operating proportional band and the second measurements.

Clause 3. The method of any of the clauses, wherein controlling the speed of the first stage compressor based on the constant band control further includes: determining the constant speed setting during an operation of the first stage compressor in a first instance, the first instance occurring when the first measurements are within the target parameter band; and wherein operating the compressor at the constant speed setting occurs after the constant speed setting has been determined in the first instance and upon determining that the first measurements are within the target parameter band.

Clause 4. The method of any of the clauses, wherein determining the constant speed setting further includes: initiating operation of the first stage compressor, wherein at initiation the first measurements are over the first threshold; operating the first stage compressor at a maximum speed while the first measurements are over the first threshold; adjusting the speed of first stage compressor in response to the first measurements dropping below the first threshold, the adjusting including decreasing the speed of the first stage compressor based on the proportional rate control; recording a plurality of operating speeds of the first stage compressor while the first measurements are within the target parameter band in the first instance; and setting the constant speed setting based on the plurality of recorded operating speeds.

Clause 5. The method of any of the clauses, wherein setting the constant speed setting includes setting the constant speed setting based on an average of the recorded plurality of operating speeds.

Clause 6. The method of any of the clauses, wherein controlling the speed of the first stage compressor based on the constant band control further includes: operating the first stage compressor at a maximum speed setting upon determining that the first measurements are above the first threshold; and operating the first stage compressor at a minimum speed setting upon determining that the first measurement are below the second threshold.

Clause 7. The method of any of the clauses, wherein the constant band control further includes receiving a user input to set one or more of the following: the first setpoint, the band offset, the first threshold, and the second threshold.

Clause 8. The method of any of the clauses, wherein the first temperature measurements are temperature measurements associated with an interstage heat exchanger of the cascade vapor compression system, and wherein the first setpoint is a setpoint associated with the interstage heat exchanger.

Clause 9. The method of any of the clauses, wherein the first setpoint is about −23° C. and the band offset is about 1° C. in either direction of the setpoint.

Clause 10. A method of controlling a cascade vapor compression system, the cascade vapor compression system including a first stage compressor configured to circulate refrigerant in a first stage refrigeration circuit, and a second stage compressor configured to circulate refrigerant in a second stage refrigeration circuit, the method comprising: receiving first measurements over time indicative of a first parameter associated with the cascade vapor compression system; receiving second measurements over time indicative of a second parameter associated with the second stage refrigeration circuit; controlling a speed of the first stage compressor based on a constant band control, wherein controlling the speed of the first stage compressor based on the constant band control includes, in part, a comparison between the first measurements and a first setpoint, the constant band control further including a constant speed setting; and controlling a speed of the second stage compressor based on a proportional band control, wherein controlling the speed of the second stage compressor based on the proportional band control includes: identifying an operating proportional band from a plurality of proportional bands, each of the plurality of proportional bands including a maximum operating speed, a minimum operating speed, and a proportional factor, wherein each of the plurality of proportional bands includes a different proportional factor than any other proportional band in the plurality of proportional bands, and adjusting the speed of the second stage compressor based on the operating proportional band and the second measurements.

Clause 11. The method of any of the clauses, wherein controlling the speed of the first stage compressor based on the constant band control further includes: operating the first stage compressor at the constant speed setting upon determining that the first measurements are within a target parameter band, wherein the target parameter band is defined by the first setpoint and a band offset, and adjusting the speed of the first stage compressor based on a proportional rate control upon determining that the first measurements are outside the target parameter band and within a first threshold and a second threshold.

Clause 12. The method of any of the clauses, wherein adjusting the speed of the second stage compressor based on the operating proportional band further includes: operating the second stage compressor at the maximum operating speed of the operating proportional band upon determining that the second measurements are above a high setpoint, and adjusting the speed of the second stage compressor based on the proportional factor of the operating proportional band upon determining that the second temperature measurements are between the high setpoint and a low setpoint.

Clause 13. The method of any of the clauses, further comprising shutting off the first stage compressor and the second stage compressor in response to the second measurements being below a low setpoint.

Clause 14. The method of any of the clauses, wherein identifying the operating proportional band further includes switching to the operating proportional band from a previous proportional band in response to the second measurements being higher than the second setpoint for a set period of time.

Clause 15. The method of any of the clauses, wherein the set period of time continues in response to the second measurements being lower than the high setpoint, and the set period of time restarts in response to the second measurements being at or below the second setpoint.

Clause 16. The method of any of the clauses, wherein identifying the operating proportional band further includes: switching to the operating proportional band from a previous proportional band in response to the second measurements being lower than the second setpoint for a set period of time.

Clause 17. The method of any of the clauses, wherein identifying the operating proportional band further includes switching between the plurality of proportional bands to identify the operating proportional band, wherein the switching occurs in response to the second measurements being either above the second setpoint for a set period of time or below the second setpoint for the set period of time.

Clause 18. The method of any of the clauses, wherein each of the plurality of proportional bands includes the same minimum operating speed and a different maximum operating speed, wherein the different maximum operating speeds differ based on a regular amount such that each successive maximum operating level is less than the previous maximum operating speed by the regular amount, and wherein the proportional factor for each of the plurality of proportional bands is based on the minimum operating speed and the maximum operating speed for a said each proportional band.

Clause 19. The method of any of the clauses, wherein the proportional band control further includes receiving a user input to set one or more of the following: the second setpoint, the set period of time, the low temperature setpoint, and the high temperature setpoint.

Clause 20. The method of any of the clauses, wherein the second temperature measurements are temperature measurements associated with a chamber conditioned by the cascade vapor compression system, and wherein the second setpoint is a setpoint associated with the chamber.

Clause 21. The method of any of the clauses, wherein the setpoint associated with the chamber is about −80° C.

Clause 22. A method of controlling a cascade vapor compression system, the cascade vapor compression system including a first stage compressor configured to circulate refrigerant in a first stage refrigeration circuit, and a second stage compressor configured to circulate refrigerant in a second stage refrigeration circuit, the method comprising: receiving first measurements over time indicative of a measured parameter associated with the cascade vapor compression system; receiving second measurements over time indicative of a measured parameter associated with the second stage refrigeration circuit; controlling a speed of the first stage compressor based on a constant band control, wherein controlling the first stage compressor based on the constant band control includes: operating the first stage compressor at a constant speed setting upon determining that the first measurements are within a target parameter band, wherein the target parameter band is defined by a first setpoint and a band offset, and adjusting the speed of the first stage compressor based on a proportional rate control upon determining that the first measurements are outside the target parameter band and within a first threshold and a second threshold; and controlling a speed of the second stage compressor based on a proportional band control, wherein controlling the speed of the second stage compressor based on the proportional band control includes: identifying an operating proportional band from a plurality of proportional bands, each of the plurality of proportional bands including a maximum operating speed, a minimum operating speed, and a proportional factor, wherein each of the plurality of proportional bands includes a different proportional factor than any other proportional band in the plurality of proportional bands, and adjusting the speed of the second stage compressor based on the operating proportional band and the second measurements.

Clause 23. The method of any of the clauses, wherein adjusting the speed of the second stage compressor based on the operating proportional band further includes: operating the second stage compressor at the maximum operating speed of the operating proportional band upon determining that the second measurements are above a high setpoint, and adjusting the speed of the second stage compressor based on the proportional factor of the operating proportional band upon determining that the second measurements are between the high setpoint and a low setpoint.

Clause 24. The method of any of the clauses, wherein the first measurements are temperature measurements associated with an interstage heat exchanger of the cascade vapor compression system, and wherein the first setpoint is a temperature setpoint associated with the interstage heat exchanger, and the first setpoint is about −23° C. and the band offset is about 1° C. in either direction of the first setpoint; and wherein the second measurements are temperature measurements associated with a chamber conditioned by the cascade vapor compression system, and wherein the second setpoint is a temperature setpoint associated with the chamber, and the second setpoint is about −80° C.

Clause 25. A cascade vapor compression system comprising: a first stage compressor configured to circulate refrigerant in a first stage refrigeration circuit; a second stage compressor configured to circulate refrigerant in a second stage refrigeration circuit; and a controller operably coupled to the first stage compressor and the second stage compressor, the controller including a processor and a memory configured to store computer-readable program code including a control-related software application; and the processor configured to access the memory, and execute the computer-readable program code to cause the processor to at least: receive first measurements over time indicative of a first parameter associated with the cascade vapor compression system; receive second measurements over time indicative of a second parameter associated with the second stage refrigeration circuit; control a speed of the first stage compressor based on a constant band control, wherein causing the processor to control the speed of the first stage compressor based on the constant band control further includes causing the processor to: operate the first stage compressor at a constant speed setting upon determining that the first measurements are within a target parameter band, wherein the target parameter band is defined by a first setpoint and a band offset, and adjust the speed of the first stage compressor based on a proportional rate control upon determining that the first measurements are outside the target parameter band and within a first threshold and a second threshold; and control a speed of the second stage compressor based on a proportional band control, wherein controlling the second stage compressor based on the proportional band control is based on, in part, the second measurements and a second setpoint, the proportional band control further including a plurality of proportional bands, each of the plurality of proportional bands including a different proportional factor than any other proportional band in the plurality of proportional bands.

Clause 26. The cascade vapor compression system of any of the clauses, wherein causing the processor to control the speed of the second stage compressor based on the proportional band control further includes causing the processor to: identify an operating proportional band from the plurality of proportional bands, each of the plurality of proportional bands including a maximum operating speed, a minimum operating speed, and the proportional factor, and adjust the speed of the second stage compressor based on the operating proportional band and the second measurements.

Clause 27. The cascade vapor compression system of any of the clauses, wherein causing the processor to control the speed of the first stage compressor based on the constant band control further includes causing the processor to: determine the constant speed setting during an operation of the first stage compressor in a first instance, the first instance occurring when the first measurements are within the target parameter band; and wherein causing the processor to operate the compressor at the constant speed setting further includes causing the processor to operate the compressor at the constant speed setting after the constant speed setting has been determined in the first instance and upon determining that the first measurements are within the target parameter band.

Clause 28. The cascade vapor compression system of any of the clauses, wherein causing the processor to determine the constant speed setting further includes causing the processor to: initiate operation of the first stage compressor, wherein at initiation the first measurements are over the first threshold; operate the first stage compressor at a maximum speed while the first measurements are over the first threshold; adjust the speed of first stage compressor in response to the first measurements dropping below the first threshold, the adjusting including decreasing the speed of the first stage compressor based on the proportional rate control; record a plurality of operating speeds of the first stage compressor while the first measurements are within the target parameter band in the first instance; and set the constant speed setting based on the plurality of recorded operating speeds.

Clause 29. The cascade vapor compression system of any of the clauses, wherein causing the processor to set the constant speed setting further includes causing the processor to set the constant speed setting based on an average of the recorded plurality of operating speeds.

Clause 30. The cascade vapor compression system of any of the clauses, wherein causing the processor to control the speed of the first stage compressor based on the constant band control further includes causing the processor to: operate the first stage compressor at a maximum speed setting upon determining that the first measurements are above the first threshold; and operate the first stage compressor at a minimum speed setting upon determining that the first measurements are below the second threshold.

Clause 31. The cascade vapor compression system of any of the clauses, further comprising: an interstage heat exchanger configured to transfer thermal energy between the first stage refrigerant circuit and the second stage refrigerant circuit; and wherein the first temperature measurements are temperature measurements associated with the interstage heat exchanger, and wherein the first setpoint is a temperature setpoint associated with the interstage heat exchanger, wherein the first setpoint is about −23° C. and the band offset is about 1° C. in either direction of the setpoint.

Clause 32. The cascade vapor compression system of any of the clauses, wherein the processor configured to access the memory, and execute the computer-readable program code further includes causing the processor to: receive a user input to set one or more of the following: the first setpoint, the band offset, the first threshold, and the second threshold.

Clause 33. A cascade vapor compression system comprising: a first stage compressor configured to circulate refrigerant in a first stage refrigeration circuit; a second stage compressor configured to circulate refrigerant in a second stage refrigeration circuit; and a controller operably coupled to the first stage compressor and the second stage compressor, the controller including a processor and a memory configured to store computer-readable program code including a control-related software application; and the processor configured to access the memory, and execute the computer-readable program code to cause the processor to at least: receive first measurements over time indicative of a first parameter associated with the cascade vapor compression system; receive second measurements over time indicative of a second parameter associated with the second stage refrigeration circuit; control a speed of the first stage compressor based on a constant band control, wherein controlling the speed of the first stage compressor based on the constant band control includes, in part, a comparison between the first measurements and a first setpoint, the constant band control further including a constant speed setting; and control a speed of the second stage compressor based on a proportional band control, wherein causing the processor to control the speed of the second stage compressor based on the proportional band control further includes causing the processor to: identify an operating proportional band from a plurality of proportional bands, each of the plurality of proportional bands including a maximum operating speed, a minimum operating speed, and a proportional factor, wherein each of the plurality of proportional bands includes a different proportional factor than any other proportional band in the plurality of proportional bands, and adjust the speed of the second stage compressor based on the operating proportional band and the second measurements.

Clause 34. The cascade vapor compression system of any of the clauses, wherein causing the processor to control the speed of the first stage compressor based on the constant band control further includes causing the processor to: operate the first stage compressor at the constant speed setting upon determining that the first measurements are within a target parameter band, wherein the target parameter band is defined by the first setpoint and a band offset, and adjust the speed of the first stage compressor based on a proportional rate control upon determining that the first measurements are outside the target parameter band and within a first threshold and a second threshold.

Clause 35. The cascade vapor compression system of any of the clauses, wherein causing the processor to adjust the speed of the second stage compressor based on the operating proportional band further includes causing the processor to: operate the second stage compressor at the maximum operating speed of the operating proportional band upon determining that the second measurements are above a high setpoint, and adjust the speed of the second stage compressor based on the proportional factor of the operating proportional band upon determining that the second temperature measurements are between the high setpoint and a low setpoint.

Clause 36. The cascade vapor compression system of any of the clauses, wherein the processor configured to access the memory, and execute the computer-readable program code further includes causing the processor to: shut off the first stage compressor and the second stage compressor in response to the second measurements being below a low setpoint.

Clause 37. The cascade vapor compression system of any of the clauses, wherein causing the processor to identify the operating proportional band further includes causing the processor to: switch to the operating proportional band from a previous proportional band in response to the second measurements being higher than the second setpoint for a set period of time.

Clause 38. The cascade vapor compression system of any of the clauses, wherein the set period of time continues in response to the second measurements being lower than the high setpoint, and the set period of time restarts in response to the second measurements being at or below the second setpoint.

Clause 39. The cascade vapor compression system of any of the clauses, wherein causing the processor to identify the operating proportional band further includes causing the processor to: switch to the operating proportional band from a previous proportional band in response to the second measurements being lower than the second setpoint for a set period of time.

Clause 40. The cascade vapor compression system of any of the clauses, wherein causing the processor to identify the operating proportional band further includes causing the processor to: switch between the plurality of proportional bands to identify the operating proportional band, wherein the switching occurs in response to the second measurements being either above the second setpoint for a set period of time or below the second setpoint for the set period of time.

Clause 41. The cascade vapor compression system of any of the clauses, wherein each of the plurality of proportional bands includes the same minimum operating speed and a different maximum operating speed, wherein the different maximum operating speeds differ based on a regular amount such that each successive maximum operating level is less than the previous maximum operating speed by the regular amount, and wherein the proportional factor for each of the plurality of proportional bands is based on the minimum operating speed and the maximum operating speed for a said each proportional band.

Clause 42. The cascade vapor compression system of any of the clauses, wherein the second measurements are temperature measurements associated with a chamber conditioned by the cascade vapor compression system, and wherein the second setpoint is a temperature setpoint associated with the chamber, wherein the second setpoint is about −80° C.

Clause 43. The cascade vapor compression system of any of the clauses, wherein the processor configured to access the memory, and execute the computer-readable program code further includes causing the processor to: receiving a user input to set one or more of the following: the second setpoint, the set period of time, the low temperature setpoint, and the high temperature setpoint.

Clause 44. A cascade vapor compression system comprising: a first stage compressor configured to circulate refrigerant in a first stage refrigeration circuit; a second stage compressor configured to circulate refrigerant in a second stage refrigeration circuit; and a controller operably coupled to the first stage compressor and the second stage compressor, the controller including a processor and a memory configured to store computer-readable program code including a control-related software application; and the processor configured to access the memory, and execute the computer-readable program code to cause the processor to at least: receive first measurements over time indicative of a first parameter associated with the cascade vapor compression system; receive second measurements over time indicative of a second parameter associated with the second stage refrigeration circuit; control a speed of the first stage compressor based on a constant band control, wherein causing the processor to control the speed of the first stage compressor based on the constant band control further includes causing the processor to: operate the first stage compressor at a constant speed setting upon determining that the first measurements are within a target parameter band, wherein the target parameter band is defined by a first setpoint and a band offset, and adjust the speed of the first stage compressor based on a proportional rate control upon determining that the first measurements are outside the target parameter band and within a first threshold and a second threshold; and control a speed of the second stage compressor based on a proportional band control, wherein causing the processor to control the speed of the second stage compressor based on the proportional band control further includes causing the processor to: identify an operating proportional band from a plurality of proportional bands, each of the plurality of proportional bands including a maximum operating speed, a minimum operating speed, and a proportional factor, wherein each of the plurality of proportional bands includes a different proportional factor than any other proportional band in the plurality of proportional bands, and adjust the speed of the second stage compressor based on the operating proportional band and the second measurements.

Clause 45. The cascade vapor compression system of any of the clauses, wherein causing the processor to adjust the speed of the second stage compressor based on the operating proportional band further includes causing the processor to: operate the second stage compressor at the maximum operating speed of the operating proportional band upon determining that the second measurements are above a high setpoint, and adjusting the speed of the second stage compressor based on the proportional factor of the operating proportional band upon determining that the second measurements are between the high setpoint and a low setpoint.

Clause 46. The cascade vapor compression system of any of the clauses, further comprising: an interstage heat exchanger configured to transfer thermal energy between the first stage refrigerant circuit and the second stage refrigerant circuit; and wherein the first measurements are temperature measurements associated with the interstage heat exchanger, and wherein the first setpoint is a temperature setpoint associated with the interstage heat exchanger, and the first setpoint is about −23° C. and the band offset is about 1° C. in either direction of the first setpoint; and wherein the second measurements are temperature measurements associated with a chamber conditioned by the cascade vapor compression system, and wherein the second setpoint is a temperature setpoint associated with the chamber, and the second setpoint is about −80° C.

Many modifications and other implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific implementations disclosed and that modifications and other implementations are intended to be included within the scope of the appended claims. Moreover, although the foregoing description and the associated figures describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A method of controlling a cascade vapor compression system, the cascade vapor compression system including a first stage compressor configured to circulate refrigerant in a first stage refrigeration circuit, and a second stage compressor configured to circulate refrigerant in a second stage refrigeration circuit, the method comprising:

receiving first measurements over time indicative of a first parameter associated with the cascade vapor compression system;

receiving second measurements over time indicative of a second parameter associated with the second stage refrigeration circuit;

controlling a speed of the first stage compressor based on a constant band control, wherein controlling the first stage compressor based on the constant band control includes:

operating the first stage compressor at a constant speed setting upon determining that the first measurements are within a target parameter band, wherein the target parameter band is defined by a first setpoint and a band offset, and adjusting the speed of the first stage compressor based on a proportional rate control upon determining that a portion of the first measurements is outside the target parameter band and within a first threshold and a second threshold; and controlling a speed of the second stage compressor based on a proportional band control, wherein controlling the speed of the second stage compressor based on the proportional band control is based on, in part, the second measurements and a second setpoint, the proportional band control further including a plurality of proportional bands, each of the plurality of proportional bands including a different proportional factor than any other proportional band in the plurality of proportional bands.

2. The method of claim 1, wherein controlling the speed of the second stage compressor based on the proportional band control further includes:

identifying an operating proportional band from the plurality of proportional bands, each of the plurality of proportional bands including a maximum operating speed, a minimum operating speed, and the proportional factor, and adjusting the speed of the second stage compressor based on the operating proportional band and the second measurements.

3. The method of claim 1, wherein controlling the speed of the first stage compressor based on the constant band control further includes:

determining the constant speed setting during an operation of the first stage compressor in a first instance, the first instance occurring when the first measurements are within the target parameter band; and wherein operating the compressor at the constant speed setting occurs after the constant speed setting has been determined in the first instance and upon determining that the first measurements are within the target parameter band.

4. The method of claim 3, wherein determining the constant speed setting further includes:

initiating operation of the first stage compressor, wherein at initiation the first measurements are over the first threshold;

operating the first stage compressor at a maximum speed while the first measurements are over the first threshold;

adjusting the speed of the first stage compressor in response to the portion of the first measurements dropping below the first threshold, the adjusting including decreasing the speed of the first stage compressor based on the proportional rate control;

recording a plurality of operating speeds of the first stage compressor while the first measurements are within the target parameter band in the first instance; and setting the constant speed setting based on the plurality of recorded operating speeds.

5. The method of claim 4, wherein setting the constant speed setting includes setting the constant speed setting based on an average of the recorded plurality of operating speeds.

6. The method of claim 1, wherein controlling the speed of the first stage compressor based on the constant band control further includes:

operating the first stage compressor at a maximum speed setting upon determining that the portion of the first measurements is above the first threshold; or operating the first stage compressor at a minimum speed setting upon determining that the portion of the first measurements is below the second threshold.

7. The method of claim 1, wherein the first measurements are temperature measurements associated with an interstage heat exchanger of the cascade vapor compression system, and wherein the first setpoint is a temperature setpoint associated with the interstage heat exchanger, wherein the first setpoint is about −23° C. and the band offset is about 1° C. in either direction of the first setpoint.

8. A method of controlling a cascade vapor compression system, the cascade vapor compression system including a first stage compressor configured to circulate refrigerant in a first stage refrigeration circuit, and a second stage compressor configured to circulate refrigerant in a second stage refrigeration circuit, the method comprising:

receiving first measurements over time indicative of a first parameter associated with the cascade vapor compression system;

receiving second measurements over time indicative of a second parameter associated with the second stage refrigeration circuit;

controlling a speed of the first stage compressor based on a constant band control, wherein controlling the speed of the first stage compressor based on the constant band control includes, in part, a comparison between the first measurements and a first setpoint, the constant band control further including a constant speed setting; and controlling a speed of the second stage compressor based on a proportional band control, wherein controlling the speed of the second stage compressor based on the proportional band control includes:

identifying an operating proportional band from a plurality of proportional bands, each of the plurality of proportional bands including a maximum operating speed, a minimum operating speed, and a proportional factor, wherein each of the plurality of proportional bands includes a different proportional factor than any other proportional band in the plurality of proportional bands, and adjusting the speed of the second stage compressor based on the operating proportional band and the second measurements.

9. The method of claim 8, wherein controlling the speed of the first stage compressor based on the constant band control further includes:

operating the first stage compressor at the constant speed setting upon determining that the first measurements are within a target parameter band, wherein the target parameter band is defined by the first setpoint and a band offset, and adjusting the speed of the first stage compressor based on a proportional rate control upon determining that a portion of the first measurements is outside the target parameter band and within a first threshold and a second threshold.

10. The method of claim 8, wherein adjusting the speed of the second stage compressor based on the operating proportional band further includes:

operating the second stage compressor at the maximum operating speed of the operating proportional band upon determining that the second measurements are above a high setpoint, and adjusting the speed of the second stage compressor based on the proportional factor of the operating proportional band upon determining that a portion of the second measurements is between the high setpoint and a low setpoint.

11. The method of claim 8, further comprising:

shutting off the first stage compressor and the second stage compressor in response to a portion of the second measurements being below a low setpoint.

12. The method of claim 8, wherein identifying the operating proportional band further includes:

switching to the operating proportional band from a previous proportional band in response to a portion of the second measurements being higher than a second setpoint for a set period of time.

13. The method of claim 12, wherein the set period of time continues in response to the second measurements being lower than the high setpoint, and the set period of time restarts in response to the portion of the second measurements being at or below the second setpoint.

14. The method of claim 8, wherein identifying the operating proportional band further includes:

switching to the operating proportional band from a previous proportional band in response to a portion of the second measurements being lower than a second setpoint for a set period of time.

15. The method of claim 8, wherein identifying the operating proportional band further includes:

switching between the plurality of proportional bands to identify the operating proportional band, wherein the switching occurs in response to a portion of the second measurements being either above a second setpoint for a set period of time or below the second setpoint for the set period of time.

16. The method of claim 15, wherein each of the plurality of proportional bands includes the same minimum operating speed and a different maximum operating speed, wherein the different maximum operating speeds differ based on a regular amount such that each successive maximum operating speed is less than the previous maximum operating speed by the regular amount, and wherein the proportional factor for each of the plurality of proportional bands is based on the minimum operating speed and the maximum operating speed for a said each proportional band.

17. The method of claim 8, wherein the second measurements are temperature measurements associated with a chamber conditioned by the cascade vapor compression system, and wherein a second setpoint is a temperature setpoint associated with the chamber, wherein the second setpoint is about −80° C.

18. A method of controlling a cascade vapor compression system, the cascade vapor compression system including a first stage compressor configured to circulate refrigerant in a first stage refrigeration circuit, and a second stage compressor configured to circulate refrigerant in a second stage refrigeration circuit, the method comprising:

receiving first measurements over time indicative of a measured parameter associated with the cascade vapor compression system;

receiving second measurements over time indicative of a measured parameter associated with the second stage refrigeration circuit;

controlling a speed of the first stage compressor based on a constant band control, wherein controlling the first stage compressor based on the constant band control includes:

operating the first stage compressor at a constant speed setting upon determining that the first measurements are within a target parameter band, wherein the target parameter band is defined by a first setpoint and a band offset, and adjusting the speed of the first stage compressor based on a proportional rate control upon determining that a portion of the first measurements is outside the target parameter band and within a first threshold and a second threshold; and controlling a speed of the second stage compressor based on a proportional band control, wherein controlling the speed of the second stage compressor based on the proportional band control includes:

identifying an operating proportional band from a plurality of proportional bands, each of the plurality of proportional bands including a maximum operating speed, a minimum operating speed, and a proportional factor, wherein each of the plurality of proportional bands includes a different proportional factor than any other proportional band in the plurality of proportional bands, and adjusting the speed of the second stage compressor based on the operating proportional band and the second measurements.

19. The method of claim 18, wherein adjusting the speed of the second stage compressor based on the operating proportional band further includes:

operating the second stage compressor at the maximum operating speed of the operating proportional band upon determining that a portion of the second measurements is above a high setpoint, and adjusting the speed of the second stage compressor based on the proportional factor of the operating proportional band upon determining that the second measurements are between the high setpoint and a low setpoint.

20. The method of claim 18, wherein the first measurements are temperature measurements associated with an interstage heat exchanger of the cascade vapor compression system, and wherein the first setpoint is a temperature setpoint associated with the interstage heat exchanger, and the first setpoint is about −23° C. and the band offset is about 1° C. in either direction of the first setpoint; and wherein the second measurements are temperature measurements associated with a chamber conditioned by the cascade vapor compression system, and wherein a second setpoint is a temperature setpoint associated with the chamber, and the second setpoint is about −80° C.

* * * * *